US010663913B2

(12) United States Patent
Yamaai et al.

(10) Patent No.: US 10,663,913 B2
(45) Date of Patent: May 26, 2020

(54) PROCESS CARTRIDGE AND ELECTROPHOTOGRAPHIC APPARATUS

(71) Applicant: CANON KABUSHIKI KAISHA, Tokyo (JP)

(72) Inventors: Tatsuya Yamaai, Yokohama (JP); Kazunori Noguchi, Suntou-gun (JP); Shuhei Iwasaki, Yokohama (JP); Akira Sakakibara, Susono (JP); Daisuke Miura, Tokyo (JP); Harunobu Ogaki, Suntou-gun (JP); Takumi Furukawa, Susono (JP); Yuya Tomomizu, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/198,008

(22) Filed: Nov. 21, 2018

(65) Prior Publication Data

US 2019/0163119 A1 May 30, 2019

(30) Foreign Application Priority Data

Nov. 24, 2017 (JP) ..... 2017-226347

(51) Int. Cl.

| | |
|---|---|
| ***G03G 9/087*** | (2006.01) |
| ***G03G 21/18*** | (2006.01) |
| ***G03G 5/06*** | (2006.01) |
| ***G03G 15/00*** | (2006.01) |
| ***G03G 15/02*** | (2006.01) |

(52) U.S. Cl.
CPC ..... *G03G 21/1814* (2013.01); *G03G 5/0614* (2013.01); *G03G 15/0233* (2013.01); *G03G 15/75* (2013.01)

(58) Field of Classification Search
CPC ..... G03G 5/14756; G03G 15/0216; G03G 15/0233
See application file for complete search history.

(56) References Cited

U.S. PATENT DOCUMENTS

| | | | |
|---|---|---|---|
| 6,991,881 | B2 | 1/2006 | Ogaki et al. |
| 6,994,941 | B2 | 2/2006 | Tanaka et al. |
| 7,001,699 | B2 | 2/2006 | Tanaka et al. |
| 7,045,261 | B2 | 5/2006 | Tanaka et al. |

(Continued)

FOREIGN PATENT DOCUMENTS

| | | | | |
|---|---|---|---|---|
| JP | 2008-276026 | | 11/2008 | |
| JP | 2010-217598 | * | 9/2010 | ..... G03G 21/00 |

(Continued)

OTHER PUBLICATIONS

Translation of JP 2010-217598.*
U.S. Appl. No. 16/198,105, Daisuke Miura, filed Nov. 21, 2018.
U.S. Appl. No. 16/196,106, Shuhei Iwasaki, filed Nov. 20, 2018.

*Primary Examiner* — Peter L Vajda
(74) *Attorney, Agent, or Firm* — Venable LLP

(57) ABSTRACT

Provided is a process cartridge having a charging member and an electrophotographic photosensitive member to be charged by being in contact with the charging member, wherein the electrophotographic photosensitive member has a support and a photosensitive layer in this order, and a surface layer of the electrophotographic photosensitive member has a Martens hardness of 230 N/mm$^2$ or less.

14 Claims, 7 Drawing Sheets

(56) References Cited

U.S. PATENT DOCUMENTS

| | | | |
|---|---|---|---|
| 7,413,840 | B1 | 8/2008 | Ogaki et al. |
| 7,551,878 | B2 | 6/2009 | Ogaki et al. |
| 7,622,238 | B2 | 11/2009 | Uematsu et al. |
| 7,629,102 | B2 | 12/2009 | Ochi et al. |
| 7,645,547 | B2 | 1/2010 | Okuda et al. |
| 7,655,370 | B2 | 2/2010 | Kitamura et al. |
| 7,693,457 | B2 | 4/2010 | Kuruma et al. |
| 7,704,657 | B2 | 4/2010 | Uesugi et al. |
| 7,718,331 | B2 | 5/2010 | Uematsu et al. |
| 7,749,667 | B2 | 7/2010 | Kawahara et al. |
| 7,838,190 | B2 | 11/2010 | Ogaki et al. |
| 7,875,410 | B2 | 1/2011 | Ogaki et al. |
| 7,927,774 | B2 | 4/2011 | Ogaki et al. |
| 7,931,848 | B2 | 4/2011 | Ochi et al. |
| 7,962,068 | B2 | 6/2011 | Kuroda et al. |
| 8,445,113 | B2 | 5/2013 | Furukawa et al. |
| 8,457,528 | B2 | 6/2013 | Ochi et al. |
| 8,469,867 | B2 | 6/2013 | Kuroda et al. |
| 8,501,325 | B2 | 8/2013 | Tomomizu et al. |
| 8,503,911 | B2 | 8/2013 | Suzumura et al. |
| 8,526,857 | B2 | 9/2013 | Tomomizu et al. |
| 8,622,881 | B1 | 1/2014 | Harada et al. |
| 8,669,027 | B2 | 3/2014 | Anezaki et al. |
| 8,685,601 | B2 | 4/2014 | Nose et al. |
| 8,753,789 | B2 | 6/2014 | Ogaki et al. |
| 8,755,714 | B2 | 6/2014 | Nagamine et al. |
| 8,815,479 | B2 | 8/2014 | Shida et al. |
| 8,846,281 | B2 | 9/2014 | Okuda et al. |
| 8,865,380 | B2 | 10/2014 | Noguchi et al. |
| 8,921,020 | B2 | 12/2014 | Murai et al. |
| 8,980,508 | B2 | 3/2015 | Okuda et al. |
| 8,980,509 | B2 | 3/2015 | Noguchi et al. |
| 8,991,053 | B2 | 3/2015 | Watanabe et al. |
| 9,034,545 | B2 | 5/2015 | Maruyama et al. |
| 9,114,565 | B2 | 8/2015 | Kawai et al. |
| 9,188,888 | B2 | 11/2015 | Okuda et al. |
| 9,207,550 | B2 | 12/2015 | Okuda et al. |
| 9,235,144 | B2 | 1/2016 | Yamamoto et al. |
| 9,274,442 | B2 | 3/2016 | Sato et al. |
| 9,280,071 | B2 | 3/2016 | Maruyama et al. |
| 9,280,072 | B2 | 3/2016 | Ogaki et al. |
| 9,282,615 | B2 | 3/2016 | Yamagishi et al. |
| 9,304,414 | B2 | 4/2016 | Miura et al. |
| 9,304,416 | B2 | 4/2016 | Noguchi et al. |
| 9,341,964 | B2 | 5/2016 | Ogaki et al. |
| 9,360,833 | B2 | 6/2016 | Terada et al. |
| 9,372,428 | B2 | 6/2016 | Kuroda et al. |
| 9,436,107 | B2 | 9/2016 | Murakami et al. |
| 9,507,283 | B2 | 11/2016 | Maruyama et al. |
| 9,575,422 | B2 | 2/2017 | Okuda et al. |
| 9,599,917 | B2 | 3/2017 | Okuda et al. |
| 9,651,879 | B2 | 5/2017 | Maruyama et al. |
| 9,726,992 | B2 | 8/2017 | Sakuma et al. |
| 9,791,792 | B2 | 10/2017 | Miyauchi et al. |
| 9,851,646 | B2 | 12/2017 | Tomono et al. |
| 9,904,199 | B2 | 2/2018 | Terada et al. |
| 9,910,379 | B2 | 3/2018 | Furukawa et al. |
| 10,025,216 | B2 | 7/2018 | Uematsu et al. |
| 10,146,149 | B2 | 12/2018 | Watanabe et al. |
| 2012/0076535 | A1 | 3/2012 | Nagamine et al. |
| 2013/0004206 | A1 | 1/2013 | Kuroda et al. |
| 2013/0034369 | A1 | 2/2013 | Masu et al. |
| 2013/0064571 | A1 | 3/2013 | Kodama et al. |
| 2014/0154618 | A1 | 6/2014 | Maruyama et al. |
| 2014/0212800 | A1 | 7/2014 | Miura et al. |
| 2014/0356773 | A1* | 12/2014 | Azuma ..... G03G 5/047 430/59.6 |
| 2015/0185630 | A1 | 7/2015 | Ito et al. |
| 2016/0291487 | A1* | 10/2016 | Uematsu ..... G03G 5/043 |
| 2017/0060008 | A1 | 3/2017 | Okuda et al. |
| 2018/0059558 | A1 | 3/2018 | Ito et al. |
| 2018/0101107 | A1 | 4/2018 | Tomomizu et al. |
| 2018/0120727 | A1 | 5/2018 | Masu et al. |

FOREIGN PATENT DOCUMENTS

| | | |
|---|---|---|
| JP | 2011-237470 | 11/2011 |
| JP | 2016-197236 | 11/2016 |

* cited by examiner

PROCESS CARTRIDGE AND ELECTROPHOTOGRAPHIC APPARATUS

BACKGROUND OF THE INVENTION

Field of the Invention

The present invention relates to a process cartridge and an electrophotographic apparatus.

Description of the Related Art

As a method of primary charging of an electrophotographic image forming apparatus, a contact charging method has been put into practical use. This is aimed at the low ozone and the low electric power, and in particular as a charging member, a roller charging system using a conductive roller is preferred in terms of the charging stability, and has been widely used.

For the purpose of uniformly charging a photosensitive member in a roller charging system, a charging member for contact charging, on the surface of which a surface layer having convex portions derived from resin particles or the like is provided, has been disclosed in Japanese Patent Application Laid-Open No. 2008-276026. It has been considered that when such a charging member is used, in a nip part with a photosensitive member, there is a function of increasing the discharge space by forming minute voids with convex portions, and leveling off the streak-like charging unevenness generated on the upstream side of the nip part by the discharge in the nip while promoting the discharge.

In addition, in Japanese Patent Application Laid-Open No. 2011-237470 and Japanese Patent Application Laid-Open No. 2016-197236, a charging member that contains bowl-shaped resin particles each having an opening in a conductive resin layer, and has a concave and convex shape derived from the opening and edge of the bowl-shaped resin particle on a surface of the charging member has been proposed. In the charging member described in Japanese Patent Application Laid-Open No. 2011-237470 and Japanese Patent Application Laid Open No. 2016-197236, by further suppressing the sticking of dirt onto a surface of the charging member, the effect of suppressing streak-like charging unevenness can be maintained even in long-term use.

However, along with the higher durability required in an electrophotographic apparatus in recent years, the stabilization of charging is required in further longer-term use. In the charging member described in Japanese Patent Application Laid-Open No. 2016-197236, the stable charging was obtained within the range of a certain number of sheets used, however, it was found that there may be a case where a streak-like image is gradually generated due to the charging unevenness as the number of sheets used is increased.

SUMMARY OF THE INVENTION

An object of the present invention is to provide a process cartridge and an electrophotographic apparatus, which are excellent in the stabilization of charging over a further longer period of use.

The present invention is to provide a process cartridge including a charging member and an electrophotographic photosensitive member to be charged by being in contact with the charging member, wherein the charging member has an electroconductive substrate and a conductive elastic layer as a surface layer; the elastic layer contains a binder and a bowl-shaped resin particle having an opening; the opening is retained in a state of being exposed on a surface of the charging member; a surface of the elastic layer has a concave portion derived from the opening and a convex portion derived from an edge of the opening; the electrophotographic photosensitive member has a support and a photosensitive layer in this order; and a surface layer of the electrophotographic photosensitive member has a Martens hardness of 230 N/mm$^2$ or less. Alternatively, the present invention is to provide a process cartridge including a charging member and an electrophotographic photosensitive member to be charged by being in contact with the charging member, wherein the charging member has an electroconductive substrate and a conductive elastic layer as a surface layer; a surface of the elastic layer contains an insulating hollow particle and an insulating binder; the hollow particle forms a convex portion exposed on the surface of the elastic layer; the hollow particle has a recess at the apex part of the convex portion; the electrophotographic photosensitive member has a support and a photosensitive layer in this order; and a surface layer of the electrophotographic photosensitive member has a Martens hardness of 230 N/mm$^2$ or less.

Further features of the present invention will become apparent from the following description of exemplary embodiments with reference to the attached drawings.

DESCRIPTION OF THE EMBODIMENTS

As a result of investigations by the present inventors, it has been found that by using a process cartridge having a specific charging member and an electrophotographic photosensitive member whose surface layer has a Martens hardness of 230 N/mm$^2$ or less, the charging unevenness on the photosensitive member can be suppressed over a long period of use.

Specifically, the charging member according to the present invention has an electroconductive substrate and a conductive elastic layer as a surface layer, the elastic layer contains a binder and a bowl-shaped resin particle having an opening, and the opening is retained in a state of being exposed on a surface of the charging member. The surface of the elastic layer has a concave portion derived from the opening and a convex portion derived from an edge of the opening. Alternatively, the charging member according to the present invention has an electroconductive substrate and a conductive elastic layer as a surface layer, a surface of the elastic layer contains an insulating hollow particle and an insulating binder. The hollow particle forms a convex portion exposed on the surface of the elastic layer, and the hollow particle has a recess at the apex part of the convex portion.

Figure 1:
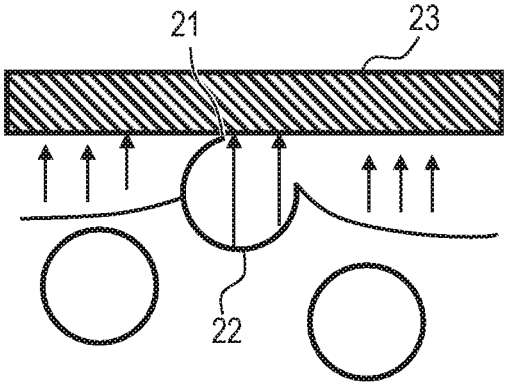
FIG. 1 is a schematic diagram showing a function of the present invention at an abutting position of the charging member and photosensitive member according to the present invention.
Figure 2:
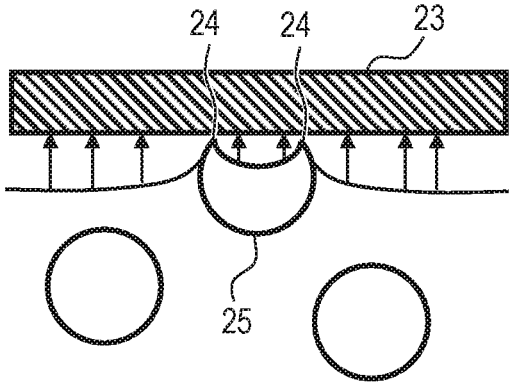
FIG. 2 is a schematic diagram showing a function of the present invention at an abutting position of the charging member and photosensitive member according to the present invention.

Although the detailed action mechanism in which the present invention exerts the effect is unknown, it is presumed as follows. At first, in each of FIGS. 1 and 2, a cross-sectional diagram showing one example of the charging member (roller) according to the present invention is shown. The charging member according to the present invention has an edge 21 of an opening of a bowl-shaped resin particle having the opening exposed on a surface of the charging member, or edges 24 due to a recess at the apex part of a hollow particle exposed on a surface. Thus, by reducing the contact area between the electrophotographic photosensitive member 23 and the charging member, the discharge space is increased, and by promoting the discharge, the charging unevenness is suppressed. However, it is presumed that when the charging member is repeatedly used, the contact area is gradually increased due to the abrasion of the edge part, and the discharge space is reduced, as a result of which the streak-like charging unevenness is deteriorated.

In the present invention, for the electrophotographic photosensitive member, by using an electrophotographic photosensitive member whose surface layer has a low hardness of a Martens hardness of 230 N/mm$^2$ or less, the abrasion of the edge part can be suppressed, and further the surface of the electrophotographic photosensitive member is soft. As a result, deformation of the shape of the edge part can also be suppressed. Due to the synergistic effect of the features of the above-described charging member and photosensitive member, the discharge space can be maintained stably even after repeated use, and therefore, it is considered that the suppression of the charging unevenness can be realized over a long period of time.

The surface layer of the electrophotographic photosensitive member contains a charge transport material and a resin, and the resin is preferably a polycarbonate resin having a structure represented by formula (I) and a structure represented by formula (II). When the polycarbonate resin is used, the hardness of the surface layer is lowered and further the durability of the photosensitive member is improved, as a result of which the uneven wear of the surface layer is reduced in repeated use, and it is advantageous for the charging unevenness.

(I)

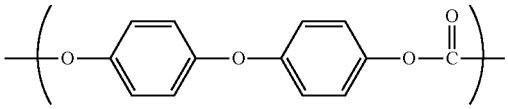

(II)

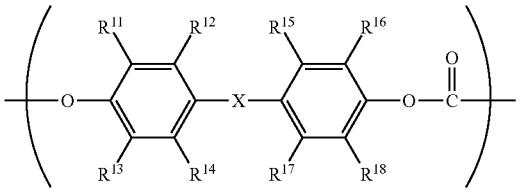

-continued (A)

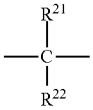

In the formula (II), $R^{11}$ to $R^{18}$ each independently represent a hydrogen atom or a methyl group.

X represents a cyclohexylidene group or a divalent group having a structure represented by the formula (A).

In the formula (A), $R^{21}$ and $R^{22}$ each independently represent a hydrogen atom, an alkyl group having 1 to 4 carbon atoms, or a phenyl group.

Examples of the structure represented by the formula (II) include the structures represented by the formulas (II-1) to (II-8).

(II-1)

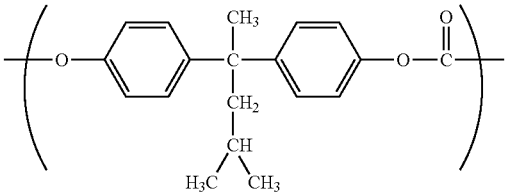

(II-2)

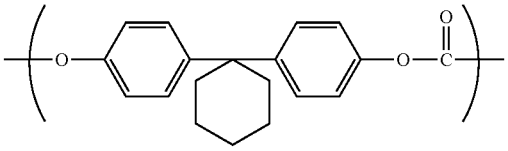

(II-3)

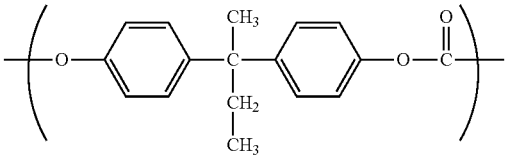

(II-4)

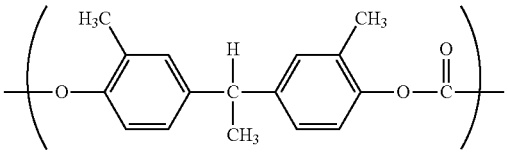

(II-5)

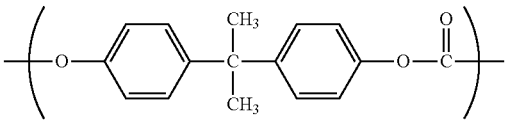

(II-6)

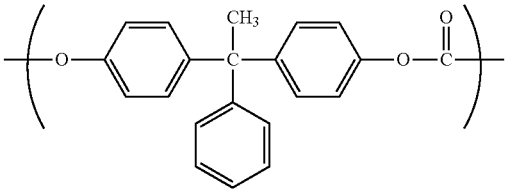

-continued (II-7)

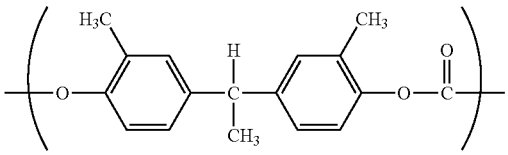

(II-8)

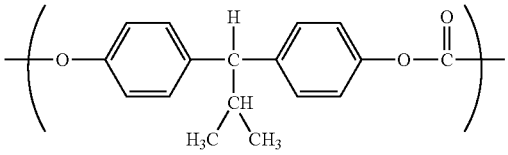

The structure represented by the formula (II) preferably has at least one structure selected from the structures represented by the formulas (II-1) to (II-5). Among them, the structure represented by the formula (II) preferably has at least one structure selected from the structures represented by the formulas (II-1), (II-2), and (II-3). It is presumed that when the above-described structure is used, the distance between the charge transport materials is made uniform, as a result of which minute potential unevenness after exposure is reduced, and thus the discharge during the charging is stabilized.

In addition, the content ratio of the structure represented by the formula (I) in the polycarbonate resin is preferably 20 mol % or more and 60 mol % or less, and more preferably 30 mol % or more and 50 mol % or less. As long as the content ratio falls within this range, both of the low hardness and the durability can be achieved.

Further, the structure represented by the formula (II) desirably has the structure represented by the formula (II-1) and the structure represented by the formula (II-2). It is presumed to be because by including the structure represented by the formula (II-1) and the structure represented by the formula (II-2), the distance between the charge transport materials is made more uniform. In addition, the proportion of the structure represented by the formula (II-1) is desirably 0.1 or more and 1.0 or less time the proportion of the structure represented by the formula (II-2) in terms of a molar ratio. Further, any structure other than the structure represented by the formula (I) and the structure represented by the formula (II) may be included.

The viscosity average molecular weight (Mv) of the polycarbonate resin according to the present invention is preferably 30,000 or more and 80,000 or less, and more preferably 40,000 or more and 70,000 or less. When the viscosity average molecular weight of the polycarbonate resin is smaller than 30,000, there may be a case where the abrasion resistance is lowered. On the other hand, when the viscosity average molecular weight of the polycarbonate resin is larger than 80,000, there may be a case where the storage stability of a coating liquid for a charge transport layer cannot be sufficiently obtained. In addition, the weight average molecular weight (Mw) the polycarbonate resin is preferably 30,000 or more and 110,000 or less, and more preferably 40,000 or more and 90,000 or less. In Examples to be described later, the viscosity average molecular weight of the polycarbonate resin was determined by measuring the intrinsic viscosity [η] at 20° C. with a 0.5 w/v % solution of polycarbonate in dichloromethane and with a Huggins constant of 0.45, using a Ubbelohde viscometer, and by the following equation.

$$[\eta]=1.23\times10-4\times(Mv)0.83$$

Further, the weight average molecular weight of the polycarbonate resin was determined by the measurement using gel permeation chromatography (GPC) [measuring instrument: Alliance HPLC system (manufactured by Waters Corporation)] with 2 columns of Shodex KF-805L column (manufactured by SHOWA DENKO K.K.) under the condition of 0.25 w/v % chloroform solution sample, 1 mL/min chloroform eluent, and UV detection at 254 nm, and by the calculation as a value in terms of polystyrene.

In addition, the intrinsic viscosity of the polycarbonate resin is preferably 0.3 dL/g to 2.0 dL/g.

Hereinafter, preferred embodiments of the present invention will be described. However, the present invention is not limited to the embodiments.

<Charging Member>

Figure 3:
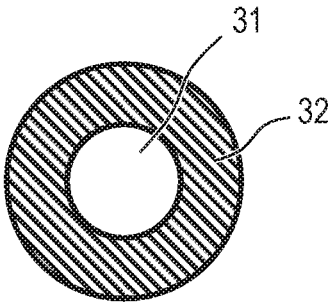
FIG. 3 is a cross-sectional diagram showing one example of the charging member (roller) according to the present invention.

As an example of the charging member, a charging member in a shape of roller (charging roller) is shown in FIG. 3. The charging member is constituted of an electroconductive substrate 31 and an elastic layer 32 arranged around the outer periphery of the electroconductive substrate 31.

(Electroconductive Substrate)

The electroconductive substrate may be any electroconductive substrate as long as it has conductivity, can support the surface layer and the like, and further can maintain the strength as the charging member.

(Conductive Elastic Layer)

Figure 4:
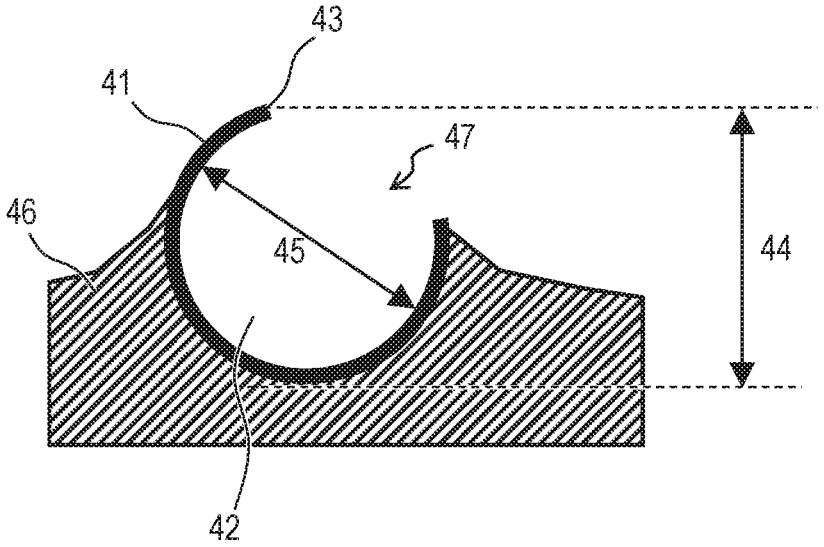
FIG. 4 is a cross-sectional diagram showing one example of the bowl-shaped resin particle according to the present invention.
Figure 5:
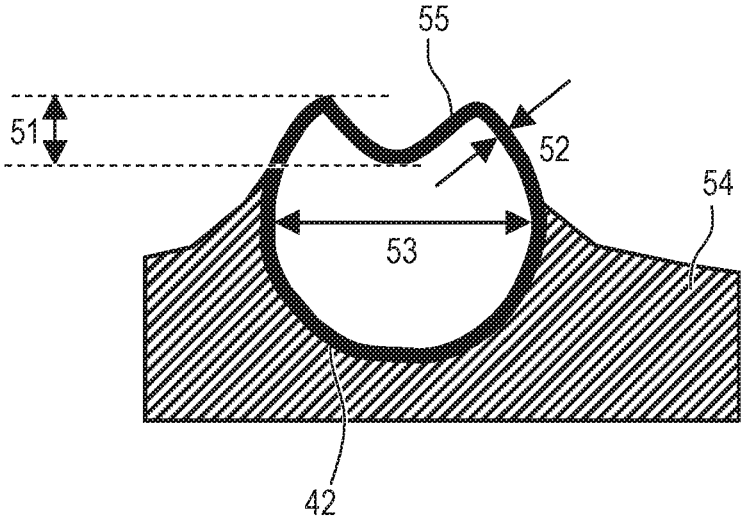
FIG. 5 is a cross-sectional diagram showing one example of the insulating hollow particle according to the present invention.

The elastic layer contains a binder and a bowl-shaped resin particle having an opening. The surface of the elastic layer has a concave portion derived from the opening and a convex portion derived from an edge of the opening (FIG. 4). Alternatively, the surface of the elastic layer contains a hollow particle and a binder, the hollow particle forms a convex portion exposed on the surface of the elastic layer, and the hollow particle has a recess at the apex part of the convex portion (FIG. 5).

As the surface having a concave portion derived from the opening and a convex portion derived from an edge of the opening, the following surface shape is preferred.

As shown in FIG. 4, a bowl-shaped resin particle 41 exposed from a binder 46 on a surface of the elastic layer has an opening 47, an edge 43 of the opening 47, and a concave portion 42 demarcated by a shell of the resin particle 41. The height difference 44 between the apex of the convex portion derived from the edge 43 and the bottom part of the concave portion 42 is preferably 5 μm or more and 50 μm or less. The maximum diameter 45 of the bowl-shaped resin particle is preferably 7 μm or more and 50 μm or less. The maximum diameter of the bowl-shaped resin particle is defined as the maximum value among the diameters of circular projection images given by the bowl-shaped resin particle.

The thickness of the shell (difference between the outer diameter and the inner diameter at the edge) around the opening part of the bowl-shaped resin particle is preferably 0.051 μm or more and 3.003 μm or less. By setting the height difference, the maximum diameter, and the thickness of the shell of the bowl-shaped resin particle to fall within the above-described ranges, the discharge space is increased, further the generation of the charging unevenness due to the concave and convex is suppressed, and therefore, this is preferred.

The hollow particle forms a convex portion exposed on a surface of the elastic layer, and as the surface having a recess derived from the hollow particle at the apex part of the convex portion, the following surface shape is preferred.

As shown in FIG. 5, the average depth 51 of the recesses derived from a hollow particle 55 exposed from a binder 54 on a surface of the elastic layer is preferably 1.0 μm or more and 6.0 μm or less. The maximum diameter 53 of the hollow particle is preferably 7 μm or more and 100 μm or less. The maximum diameter of the hollow particle is defined as the maximum value among the diameters of circular projection images given by the hollow particle. In addition, the average thickness of the shell of the hollow particle 52 is preferably 0.05 μm or more and 3.00 μm or less. By setting the average depth of the recess derived from the hollow particle, the maximum diameter, and the average thickness of the shell to fall within the above-described ranges, the discharge space is increased, further the generation of the charging unevenness due to the concave and convex is suppressed, and therefore, this is preferred.

By the formation of the concave and convex shape, the surface state of the conductive elastic layer is preferably controlled as follows. The ten-point average surface roughness (Rzjis) is preferably 5 μm or more and 35 μm or less. By setting the Rzjis to fall within the above-described range, the discharge space is increased, further the charging unevenness due to the concave and convex is not generated, and therefore, this is preferred. In this regard, the measurement method of the ten-point average roughness (Rzjis) of the surface will be described in detail later.

In order to suppress the charging unevenness due to the increase in the discharge space, the average value of the Martens hardness of the conductive elastic layer measured with a push-in force of 0.04 mN is preferably 1 $N/mm^2$ or more.

The polymer used for a binder is not particularly limited as long as it is a material showing rubber elasticity. Specific examples of the rubber material include the following one: a thermosetting rubber material in which a raw material rubber such as natural rubber (NR), isoprene rubber (IR), butadiene rubber (BR), styrene-butadiene (SBR), butyl rubber (IIR), ethylene-propylene-diene ternary copolymer rubber (EPDM), epichlorohydrin homopolymer (CHC), epichlorohydrin-ethylene oxide copolymer (CHR), epichlorohydrin-ethylene oxide-allyl glycidyl ether ternary copolymer (CHR-AGE), acrylonitrile-butadiene copolymer (NBR), a hydrogenated product of acrylonitrile-butadiene copolymer (H-NBR), chloroprene rubber (CR), and acrylic rubber (ACM, ANM) has been mixed with a crosslinking agent. Further, a mixture of these polymers may be accepted. Among them, acrylonitrile butadiene rubber is excellent in the workability, and is most suitable in the extrusion molding that is one of the embodiments of the present invention described later, and therefore, this is preferred.

In a conductive layer, carbon black as conductive particles can be mixed as needed. The kind of the carbon black to be mixed is not particularly limited. Specific examples of the carbon black to be used include the following ones: a gas furnace black, an oil furnace black, a thermal black, a lamp black, an acetylene black, and a Ketjen black.

In addition, in the composition of an elastic layer, a filler, a processing aid, a crosslinking aid, a crosslinking accelerator, a crosslinking accelerating aid, a crosslinking retarder, a softening agent, a plasticizer, a dispersant, or the like, which is generally used as a compounding agent for rubber, can be added as needed.

<Method for Producing Charging Member>

As an example of the methods for producing the charging member according to the present invention, an effective method will be described, in particular from the viewpoint that the production method is simple.

The production method refers to a method for producing a charging member, particularly a charging roller, which includes the following steps.

A step of kneading an unvulcanized rubber composition containing a rubber material as a binder and thermally expandable microcapsule particles (unvulcanized rubber kneading step). The thermally expandable microcapsule particles turns into bowl-shaped resin particles or hollow particles each having a recess in the subsequent processing step.

A step in which the unvulcanized rubber composition is crosshead extrusion-molded onto an electroconductive substrate, and then the obtained molded material is heated and vulcanized to foam the thermally expandable microcapsule particles and to form an elastic layer as the surface layer. In this step, the thermally expandable microcapsule particles foam to hollow particles.

By the subsequent step, a charging member having bowl-shaped resin particles on the surface of the charging member and a charging member having hollow particles each having a recess on the surface of the charging member are separately prepared.

(In a case of producing a charging member having bowl-shaped resin particles on the surface of the charging member)

A step of polishing the elastic layer to remove a part of the hollow particle and to form a bowl shape (In a case of producing a charging member having hollow particles each having a recess on the surface of the charging member)

A step of forming hollow particles each having a recess by shrinking the hollow particles exposed on the surface of the elastic layer, by additionally heating the elastic layer Hereinafter, each of the steps will be described in more detail.

(Unvulcanized Rubber Kneading Step)

At first, a conductive rubber composition and an unvulcanized rubber containing thermally expandable microcapsule particles, which are materials for constituting a surface layer, are kneaded.

The thermally expandable microcapsule particles are preferably used as the precursor of hollow particles. This is because when the thermally expandable microcapsule particles are used, the hollow particles are not destroyed in the kneading step.

The content of the thermally expandable microcapsule particles in the unvulcanized rubber composition is preferably 0.5 part by mass or more and 20 parts by mass or less relative to 100 parts by mass of the raw material rubber. As long as the content is in this range, a suitable amount of hollow particles can be present on the surface of the charging member.

The vulcanizing agent can be appropriately selected by taking the rubber material to be used into consideration.

(Extrusion Molding Step)

With the use of this unvulcanized rubber composition, the unvulcanized rubber composition can be formed into a roller shape for use as a charging member. As the forming method, crosshead extrusion molding is preferred.

Figure 6:
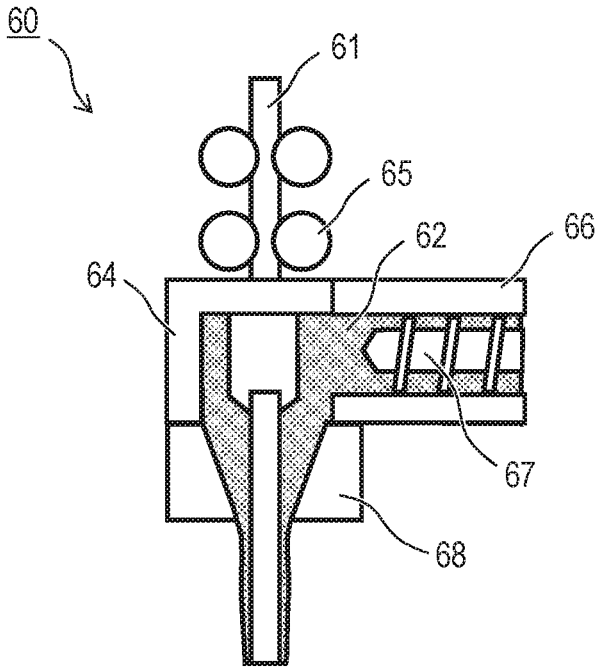
FIG. 6 is a schematic configuration diagram showing one example of a crosshead extruder.

FIG. 6 is a schematic configuration diagram showing a crosshead extruder. The crosshead extruder 60 is a device for evenly covering an electroconductive substrate 61 with an unvulcanized rubber composition 62 over the entire circumference to produce an unvulcanized rubber roller 63 with the electroconductive substrate 61 in the center of the unvulcanized rubber roller 63.

In the crosshead extruder 60, a crosshead 64, a conveying roller 65, and a cylinder 66 are arranged. The electroconductive substrate 61 is fed into the crosshead 64 by the conveying roller 65, and the unvulcanized rubber composition 62 is fed into the crosshead 64 by the cylinder 66.

The conveying roller 65 continuously feeds multiple electroconductive substrates 61 to the crosshead 64 in the axial direction. The cylinder 66 is equipped with a screw 67 inside the cylinder 66, and the unvulcanized rubber composition 62 is fed into the crosshead 64 by the rotation of the screw 67.

When the electroconductive substrate 61 is fed into the crosshead 64, the entire circumference of the electroconductive substrate 61 is covered with the unvulcanized rubber composition 62 fed from the cylinder 66 into the crosshead. Subsequently, the electroconductive substrate 61 is fed out from a die 68 at the outlet of the crosshead 64 as an unvulcanized rubber roller 63 whose surface has been covered with the unvulcanized rubber composition 62.

At that time, in order to control the thickness and particle diameter of the shell of the hollow particle after the thermally expandable microcapsule particle has foamed, and to effectively form the exposed convex portion by the hollow particle on the surface of the charging member, the extrusion molding is preferably performed at a temperature less than the foaming starting temperature of the thermally expandable microcapsule particles. In this regard, in order to prevent the vulcanization in the extruder, the extrusion molding temperature is set to be lower than the vulcanization temperature.

The unvulcanized rubber composition can be formed into a so-called crown shape having a larger outer diameter (wall thickness) in the central part than the outer diameter in the end part in the longitudinal direction of each electroconductive substrate 61. Specifically, the crown shape is formed by gradually changing the speed at which the electroconductive substrate is fed so that the speed is faster at the end part and slower in the central part while the extrusion discharge amount of the unvulcanized rubber composition is kept constant. Thus, an unvulcanized rubber roller 63 is obtained.

(Vulcanization/Foaming Step)

Next, the unvulcanized rubber roller is heated to obtain a vulcanized rubber roller with the hollow particles exposed on the surface of the vulcanized rubber roller. Specific examples of the method for heat treatment include hot-air oven heating by a gear oven, heating by far infrared rays, and steam heating by a vulcanizer. Among them, hot-air oven heating and far infrared heating are preferred because of being suitable for continuous production.

As the conditions of the heating temperature and the heating time, conditions under which a sufficient elastic modulus is obtained by vulcanization and further the thermally expandable microcapsule particles have a desired foaming ratio by foaming are preferred.

Both end parts of the rubber composition after the vulcanization/foaming are removed in the subsequent separate step, and a vulcanized/foamed rubber roller is obtained. Therefore, the obtained vulcanized/foamed rubber roller has an electroconductive substrate, both of the end parts of the electroconductive substrate are exposed.

Using this vulcanized rubber roller, by the subsequent step, a charging member having bowl-shaped resin particles on the surface of the charging member and a charging member having hollow particles each having a recess on the surface of the charging member are separately prepared.

(In the Case of Producing Charging Member Having Bowl-Shaped Resin Particles on the Surface of the Charging Member: Polishing Step)

As the polishing method of the vulcanized rubber roller, a cylindrical polishing method or a tape polishing method can be used, and since it is required to remarkably bring out the difference in the abradability between the binder and the hollow particles, the condition for polishing faster is preferred. From this viewpoint, it is more preferred to use a cylindrical polishing method. Among the cylindrical polishing methods, from the viewpoint that the longitudinal direction of the vulcanized rubber roller can be simultaneously polished and the polishing time can be shortened, it is furthermore preferred to use a plunge cut system. In addition, from the viewpoint of making the polished surface uniform, it is preferred that a spark-out step (fine polishing step at a penetration rate of 0 mm/min), which has been conventionally performed, is set to be performed in a time period of as short as possible or not performed.

As an example, the rotation speed of a cylindrical polishing wheel of the plunge cut system is preferably 1000 rpm or more and 4000 rpm or less. The rate of the penetration into the elastic layer is more preferably 5 mm/min or more and 30 mm/min or less. In the end of the penetration step, a break-in step may be performed on the polished surface, and the break-in step is preferably performed for shorter than or equal to 2 seconds at a penetration rate of 0.1 mm/min or more and 0.2 mm/min or less. The spark-out step (polishing step at a penetration rate of 0 mm/min) is preferably performed for 3 seconds or less. The rotation speed is preferably set to be 50 rpm or more and 500 rpm or less. By setting the conditions as described above, the concavo-convex formation due to the opening of the bowl-shaped resin particle can be more easily formed on a surface of the elastic layer.

(In the Case of Producing Charging Member Having Hollow Particles with Recess on the Surface of the Charging Member: Additional Heating Step)

As an additional heating method of the vulcanized rubber roller, after the vulcanization step, the hollow particle obtained by foaming thermally expandable microcapsule particle is shrunk with the heating at a higher temperature than the temperature in the vulcanization step. By additionally heating the elastic layer, the apex of a convex portion formed of the hollow particle exposed on a surface of the elastic layer is recessed, as a result of which a recess is formed.

The reason why the recess is formed is as follows. The thermally expandable microcapsule particle has a property that as the heating is continued, the internal pressure is decreased and thus the thermally expandable microcapsule particle is shrink. In the present invention, the thermally expandable microcapsule particle exposed on a surface of the elastic layer forms a recess as a result of the selective shrinking of the surface of the convex portion, which has not been surrounded by a binder.

In the present invention, in order to simplify the production process, it is most preferred that the elastic layer is a single layer, that is, the elastic layer as the surface layer is only the elastic layer. In addition, in order to ensure the nip width with a photosensitive member, the thickness of the surface layer in this case is preferably in the range of 0.8 mm or more and 4.0 mm or less, and in particular, 1.2 mm or more and 3.0 mm or less.

(Thermally Expandable Microcapsule Particles)

Each of the thermally expandable microcapsule particles has a core-shell structure, contains an encapsulated substance inside the shell as a core, and is a material that becomes a hollow particle by expanding the encapsulated substance by applying heat. Further, the thermally expandable microcapsule particle is a material that becomes a bowl-shaped resin particle by scraping a part of the hollow particle.

In a case where the thermally expandable microcapsule particle is used as a hollow particle, a thermoplastic resin can be used for the shell. Examples of the thermoplastic resin include the following ones: an acrylonitrile resin, a vinyl chloride resin, a vinylidene chloride resin, a methacrylic acid resin, a styrene resin, a urethane resin, an amide resin, a methacrylonitrile resin, an acrylic acid resin, an acrylic acid ester resin, and a methacrylic acid ester resin. These thermoplastic resins may be used alone or in combination of two or more kinds thereof. Further, the thermoplastic resin may be a copolymer obtained by copolymerizing monomers that are raw materials for these thermoplastic resins described above. In particular, a thermoplastic resin including at least one selected from an acrylonitrile resin, a vinylidene chloride resin, and a methacrylonitrile resin, which have low gas permeability and high impact resilience, is preferably used.

As the encapsulated substance of a thermally expandable microcapsule particle, one that expands in the form of a gas at a temperature of the softening point or less of the thermoplastic resin is preferred, and examples of the encapsulated substance include the following ones: a low-boiling liquid such as propane, propylene, butene, n-butane, isobutane, n-pentane, isopentane, and isopentene; and a high-boiling liquid such as n-hexane, isohexane, n-heptane, n-octane, isooctane, n-decane, and isodecane.

The thermally expandable microcapsule particles described above can be produced by a known production method such as a suspension polymerization method, an interfacial polymerization method, an interfacial precipitation method, and an in-liquid drying method. For example, as the suspension polymerization method, a method in which a polymerizable monomer, a substance to be encapsulated in the thermally expandable microcapsule particle, and a polymerization initiator are mixed, this mixture is dispersed in an aqueous medium containing a surfactant or a dispersion stabilizer, and then the resultant mixture is subjected to suspension polymerization can be mentioned. In this regard, a compound having a reactive group that reacts with a functional group of the polymerizable monomer, and an organic filler may also be added.

Examples of the polymerizable monomer include the following ones: acrylonitrile, methacrylonitrile, α-chloroacrylonitrile, α-ethoxyacrylonitrile, fumaronitrile, acrylic acid, methacrylic acid, itaconic acid, maleic acid, fumaric acid, citraconic acid, vinylidene chloride, vinyl acetate; acrylic acid ester (methyl acrylate, ethyl acrylate, n-butyl acrylate, isobutyl acrylate, t-butyl acrylate, isobornyl acrylate, cyclohexyl acrylate, and benzyl acrylate); methacrylic acid ester (methyl methacrylate, ethyl methacrylate, n-butyl methacrylate, isobutyl methacrylate, t-butyl methacrylate, isobornyl methacrylate, cyclohexyl methacrylate, and benzyl methacrylate); a styrene-based monomer, acrylamide, substituted acrylamide, methacrylamide, substituted methacrylamide, butadiene, ε caprolactam, polyether, and isocyanate. These polymerizable monomers may be used alone or in combination of two or more kinds thereof.

As the polymerization initiator, an initiator that is soluble in the polymerizable monomer is preferred, and a known peroxide initiator, and an azo initiator may be used. Among them, an azo initiator is preferred. Examples of the azo initiator include the following ones: 2,2'-azobisisobutyronitrile, 1,1'-azobis cyclohexane 1-carbonitrile, and 2,2'-azobis-4-methoxy-2,4-dimethylvaleronitrile. Among them, 2,2'-azobisisobutyronitrile is preferred. As the peroxide initiator, for example, dicumyl peroxide may be used. In a case of using a polymerization initiator, the amount of the polymerization initiator is preferably 0.01 to 5 parts by mass relative to 100 parts by weight of the polymerizable monomers.

As the surfactant, an anionic surfactant, a cationic surfactant, a nonionic surfactant, an amphoteric surfactant, or a polymer-type dispersant may be used. The use amount of the surfactant is preferably 0.01 to 10 parts by mass relative to 100 parts by weight of the polymerizable monomers.

Examples of the dispersion stabilizer include the following ones: organic fine particles (polystyrene fine particles, polymethyl methacrylate fine particles, polyacrylic acid fine particles, polyepoxide fine particles, and the like), silica (colloidal silica, and the like), calcium carbonate, calcium phosphate, aluminum hydroxide, barium carbonate, magnesium hydroxide, and the like. The use amount of the dispersion stabilizer is preferably 0.01 to 20 parts by mass relative to 100 parts by mass of the polymerizable monomers.

The suspension polymerization is preferably performed under a sealed condition by using a pressure container. Further, the raw material for polymerization may be suspension-polymerized after being suspended by a disperser or the like and then transferred to a pressure container, or may be suspended in a pressure container. The polymerization temperature is preferably 50° C. to 120° C. The polymerization may be performed at atmospheric pressure, but it is preferred to perform the polymerization under pressure (for example, under a pressure obtained by adding 0.1 to 1 MPa to atmospheric pressure) in order not to vaporize a substance to be encapsulated in the thermally expandable microcapsule particle. After completion of the polymerization, the solid-liquid separation and washing may be performed by centrifugation or filtration. In a case where the solid-liquid separation and washing are performed, subsequently drying or crushing (aggregate particles are made into primary particles) may be performed at a temperature less than the softening temperature of the resin constituting the thermally expandable microcapsule particles. The drying and crushing can be performed by a known method, and a flash dryer, a fair wind dryer, and a Nauta mixer can be used. Further, the drying and crushing can be performed at the same time with a crushing dryer. The surfactant and the dispersion stabilizer can be removed by repeatedly performing washing and filtration after the production.

The shape of the hollow particle is not particularly limited, but examples of the shape include a spherical shape, an indefinite shape, and an elliptical shape.

<Electrophotographic Photosensitive Member>

The electrophotographic photosensitive member according to the present invention has a support and a photosensitive layer in this order, and the surface layer contains a charge transport material and a resin. The photosensitive layer of the electrophotographic photosensitive member is mainly classified into (1) laminate type photosensitive layer and (2) monolayer type photosensitive layer. The (1) laminate type photosensitive layer has a charge generating layer containing a charge generating material and a charge transport layer containing a charge transport material. The (2) monolayer type photosensitive layer has a photosensitive layer containing both of a charge generating material and a charge transport material. In the present invention, in a case where a protection layer is not arranged on the photosensitive layer, the charge transport layer containing a charge transport material becomes a surface layer in a case of the (1) laminate type photosensitive layer, and the photosensitive layer containing a charge transport material becomes a surface layer in a case of the (2) monolayer type photosensitive layer.

As the method for producing the electrophotographic photosensitive member, a method in which a coating liquid for each of the layers described later is prepared, the coating liquid is applied in the desired layer order, and the drying is performed can be mentioned. At this time, examples of the applying method of the coating liquid include a dip coating method, a spray coating method, a curtain coating method, and a spin coating method. Among them, from the viewpoint of the efficiency and the productivity, a dip coating method is preferred.

Hereinafter, the support and each layer will be described.

(Support)

In the present invention, the electrophotographic photosensitive member has a support. In the present invention, the support is preferably a conductive support having conductivity. Further, examples of the shape of the support include a cylindrical shape, a belt shape, and a sheet shape. In particular, a cylindrically-shaped support is preferred. In addition, electrochemical treatment such as anodic oxidation; blast treatment; cutting treatment; or the like may be applied onto a surface of the support.

As the material for the support, metal, resin, glass, or the like is preferred.

Examples of the metal include aluminum, iron, nickel, copper, gold, stainless steel, or an alloy thereof. In particular, a support made of aluminum using aluminum is preferred.

Further, conductivity may be imparted to resin or glass by processing of mixing with a conductive material, being covered with a conductive material, or the like.

(Conductive Layer)

In the present invention, a conductive layer may be arranged on a support. By arranging a conductive layer, scratches and irregularities on a surface of a support can be hidden, and reflection of light on a surface of a support can be controlled.

The conductive layer preferably contains conductive particles and a resin.

As the material for the conductive particles, a metal oxide, a metal, a carbon black, or the like can be mentioned.

Examples of the metal oxide include zinc oxide, aluminum oxide, indium oxide, silicon oxide, zirconium oxide, tin oxide, titanium oxide, magnesium oxide, antimony oxide, and bismuth oxide. Examples of the metal include aluminum, nickel, iron, nichrome, copper, zinc, and silver.

Among them, as the conductive particle, a metal oxide is preferably used, and in particular, titanium oxide, tin oxide, or zinc oxide is more preferably used.

In a case where a metal oxide is used as the conductive particle, the surface of the metal oxide may be treated with a silane coupling agent or the like, or the metal oxide may be doped with an element such as phosphorus or aluminum, or an oxide thereof.

In addition, the conductive particle may have a lamination structure including a core material particle and a coating layer covering the particle. Examples of the core material particle include titanium oxide, barium sulfate, and zinc oxide. As the coating layer, a metal oxide such as tin oxide can be mentioned.

Further, in a case where a metal oxide is used as the conductive particle, the volume average particle diameter is preferably 1 nm or more and 500 nm or less, and more preferably 3 nm or more and 400 nm or less.

Examples of the resin include a polyester resin, a polycarbonate resin, a polyvinylacetal resin, an acrylic resin, a silicone resin, an epoxy resin, a melamine resin, a polyurethane resin, a phenol resin, and an alkyd resin.

In addition, the conductive layer may further contain a masking agent such as silicone oil, resin particles, and titanium oxide.

The average layer thickness of the conductive layer is preferably 1 μm or more and 50 μm or less, and particularly preferably 3 μm or more and 40 μm or less.

The conductive layer can be formed by preparing a coating liquid for the conductive layer, which contains the above-described respective materials and a solvent, forming the coating film, and drying the coating film. Examples of the solvent to be used for the coating liquid include an alcoholic solvent, a sulfoxide-based solvent, a ketone-based solvent, an ether-based solvent, an ester-based solvent, and an aromatic hydrocarbon-based solvent. As the dispersion method for dispersing conductive particles in a coating liquid for the conductive layer, a method using a paint shaker, a sand mill, a ball mill, or a liquid collision-type high speed disperser can be mentioned.

(Undercoat Layer)

In the present invention, an undercoat layer may be arranged on a support or a conductive layer. By arranging an undercoat layer, the adhesion function between layers is enhanced, and the charge injection blocking function can be imparted.

The undercoat layer preferably contains a resin. In addition, the undercoat layer may be formed as a cured film by polymerizing a composition containing a monomer having a polymerizable functional group.

Examples of the resin include a polyester resin, a polycarbonate resin, a polyvinylacetal resin, an acrylic resin, an epoxy resin, a melamine resin, a polyurethane resin, a phenol resin, a polyvinyl phenol resin, an alkyd resin, a polyvinyl alcohol resin, a polyethylene oxide resin, a polypropylene oxide resin, a polyamide resin, a polyamic acid resin, a polyimide resin, a polyamideimide resin, and a cellulose resin.

Examples of the polymerizable functional group possessed by the monomer having a polymerizable functional group include an isocyanate group, a blocked isocyanate group, a methylol group, an alkylated methylol group, an epoxy group, a metal alkoxide group, a hydroxyl group, an amino group, a carboxyl group, a thiol group, a carboxylic acid anhydride group, and a carbon-carbon double bond group.

In addition, for the purpose of enhancing the electric characteristics, the undercoat layer may further contain an electron transport material, a metal oxide, a metal, a conductive polymer, and the like. Among them, an electron transport material, and a metal oxide are preferably used.

Examples of the electron transport material include a quinone compound, an imide compound, a benzimidazole compound, a cyclopentadienylidene compound, a fluorenone compound, a xanthone compound, a benzophenone compound, a cyanovinyl compound, a halogenated aryl compound, a silole compound, and a boron-containing compound.

The undercoat layer may be formed as a cured film by copolymerizing a monomer having the above-described polymerizable functional group by using an electron transport material having a polymerizable functional group as the electron transport material.

Examples of the metal oxide include indium tin oxide, tin oxide, indium oxide, titanium oxide, zinc oxide, aluminum oxide, and silicon dioxide. Examples of the metal include gold, silver, and aluminum.

Further, the undercoat layer may further contain an additive agent.

The average layer thickness of the undercoat layer is preferably 0.1 μm or more and 50 μm or less, more preferably 0.2 μm or more and 40 μm or less, and particularly preferably 0.3 μm or more and 30 μm or less.

The undercoat layer can be formed by preparing a coating liquid for the undercoat layer, which contains the above-described respective materials and a solvent, forming the coating film, and drying and/or curing the coating film. Examples of the solvent to be used for the coating liquid include an alcoholic solvent, a ketone-based solvent, an ether-based solvent, an ester-based solvent, and an aromatic hydrocarbon-based solvent.

(Photosensitive Layer)

The photosensitive layer of the electrophotographic photosensitive member is mainly classified into (1) laminate type photosensitive layer and (2) monolayer type photosensitive layer. The (1) laminate type photosensitive layer has a charge generating layer containing a charge generating material and a charge transport layer containing a charge transport material. The (2) monolayer type photosensitive layer has a photosensitive layer containing both of a charge generating material and a charge transport material.

(1) Laminate Type Photosensitive Layer

The laminate type photosensitive layer has a charge generating layer and a charge transport layer.

(1-1) Charge Generation Layer

The charge generating layer preferably contains a charge generating material and a resin.

Examples of the charge generating material include an azo pigment, a perylene pigment, a polycyclic quinone pigment, an indigo pigment, and a phthalocyanine pigment. Among them, an azo pigment, and a phthalocyanine pigment are preferred. Among the phthalocyanine pigments, an oxytitanium phthalocyanine pigment, a chlorogallium phthalocyanine pigment, and a hydroxygallium phthalocyanine pigment are preferred.

The content of the charge generating material in the charge generating layer is preferably 40% by mass or more and 85% by mass or less, and more preferably 60% by mass or more and 80% by mass or less relative to the total mass of the charge generating layer.

Examples of the resin include a polyester resin, a polycarbonate resin, a polyvinylacetal resin, polyvinyl butyral resin, an acrylic resin, a silicone resin, an epoxy resin, a melamine resin, a polyurethane resin, a phenol resin, a polyvinyl alcohol resin, a cellulose resin, a polystyrene resin, a polyvinyl acetate resin, and a polyvinyl chloride resin. Among them, a polyvinyl butyral resin is more preferred.

In addition, the charge generating layer may further contain an additive agent such as an antioxidant, and a UV absorber. Specifically, a hindered phenol compound, a hindered amine compound, a sulfur compound, a phosphorus compound, a benzophenone compound, and the like can be mentioned.

The average layer thickness of the charge generating layer is preferably 0.1 μm or more and 1 μm or less, and more preferably 0.15 μm or more and 0.4 μm or less.

The charge generating layer can be formed by preparing a coating liquid for the charge generating layer, which contains the above-described respective materials and a solvent, forming the coating film, and drying the coating film. Examples of the solvent to be used for the coating liquid include an alcoholic solvent, a sulfoxide-based solvent, a ketone-based solvent, an ether-based solvent, an ester-based solvent, and an aromatic hydrocarbon-based solvent.

(1-2) Charge Transport Layer

The charge transport layer contains a charge transport material, and a resin such as a polycarbonate resin or a polyester resin.

Examples of the charge transport material include a polycyclic aromatic compound, a heterocyclic compound, a hydrazone compound, a styryl compound, an enamine compound, a benzidine compound, a triarylamine compound, and a resin having a group derived from these compounds.

In addition, the charge transport material may contain multiple kinds of materials together. Hereinafter, specific examples of the charge transport material are shown.

(CTM-1)

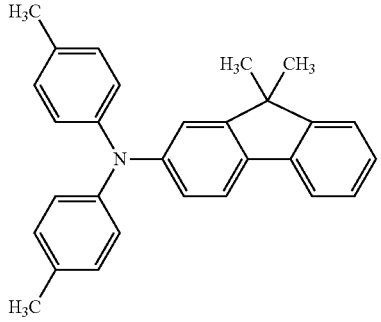

(CTM-2)

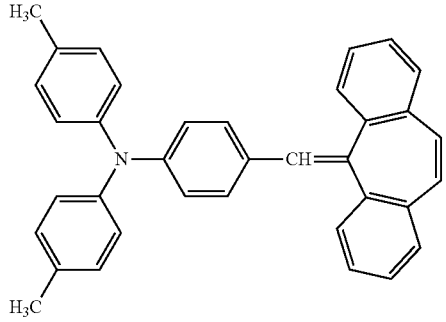

-continued
(CTM-3)
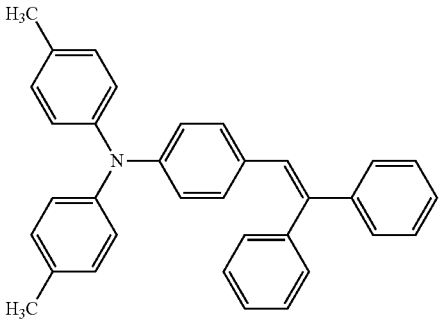
(CTM-4)
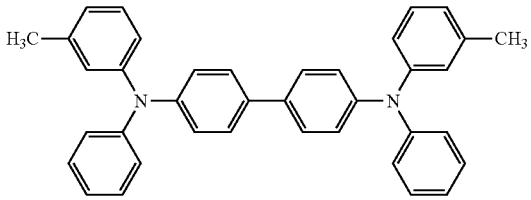
(CTM-5)
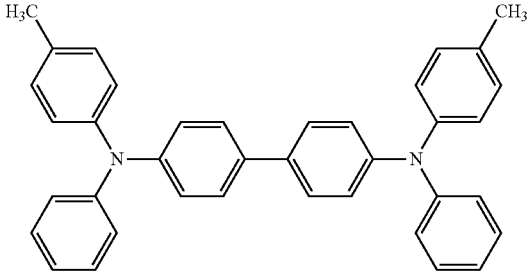
(CTM-6)
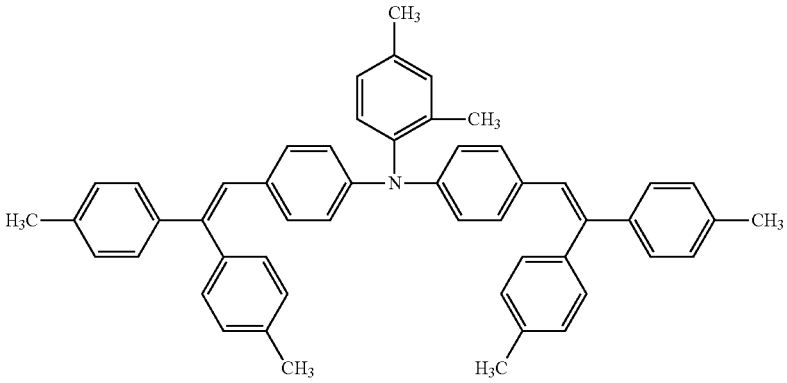
(CTM-7)
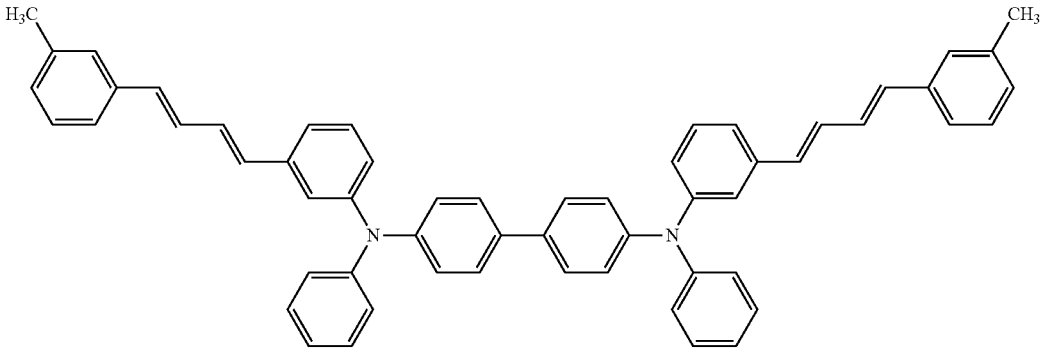

-continued (CTM-8)

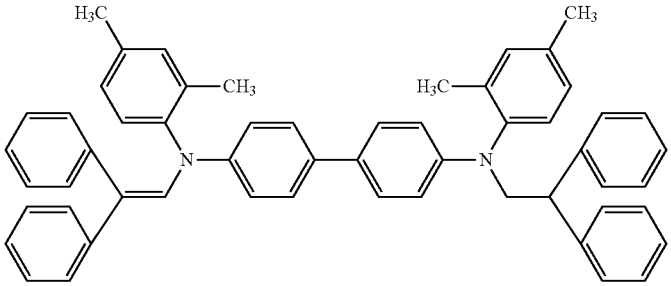

(CTM-9)

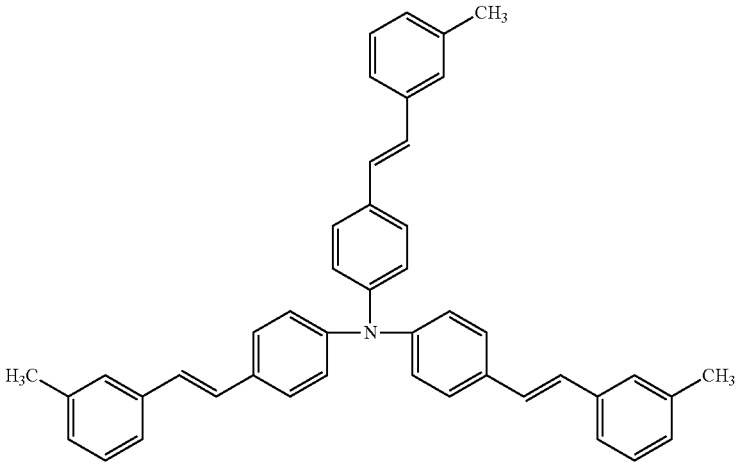

(CTM-10)

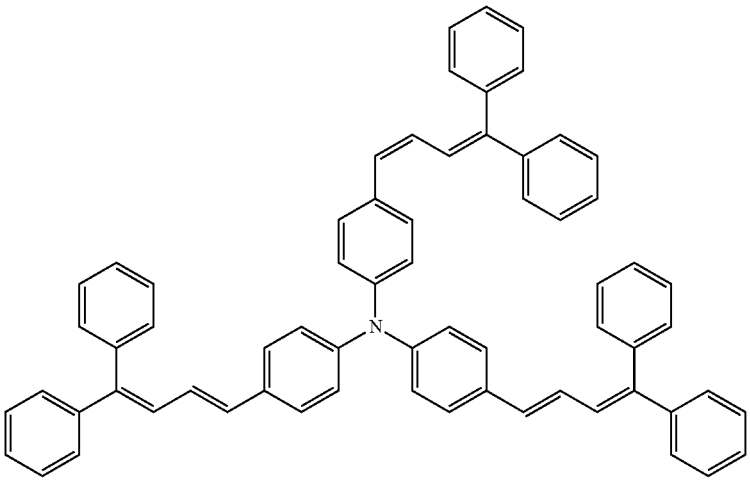

The content of the charge transport material in the charge transport layer is preferably 30% by mass or more and 120% by mass or less, and more preferably 30% by mass or more and 70% by mass or less, relative to the content of the resin such as a polycarbonate resin or a polyester resin.

The charge transport layer can be formed by forming a coating film of a coating liquid for the charge transport layer, which has been prepared by dissolving a charge transport material and a binder resin in a solvent, and drying the coating film. As the solvent used for the coating liquid for forming the charge transport layer, an alcoholic solvent, a sulfoxide-based solvent, a ketone-based solvent, an ether-based solvent, an ester-based solvent, or an aromatic hydrocarbon solvent can be mentioned.

In addition, the charge transport layer may contain an additive agent such as an antioxidant, a UV absorber, a plasticizer, a leveling agent, a lubricity imparting agent, and an abrasion resistance improver.

Specifically, a hindered phenol compound, a hindered amine compound, a sulfur compound, a phosphorus compound, a benzophenone compound, a siloxane-modified resin, a silicone oil, fluorine resin particles, polystyrene resin particles, polyethylene resin particles, alumina particles, boron nitride particles, and the like are mentioned.

The average layer thickness of the charge transport layer is preferably 5 μm or more and 50 μm or less, more preferably 8 μm or more and 40 μm or less, and particularly preferably 10 μm or more and 30 μm or less.

The charge transport layer can be formed by preparing a coating liquid for the charge transport layer, which contains the above-described respective materials and a solvent, forming the coating film, and drying the coating film. Examples of the solvent to be used for the coating liquid include an alcoholic solvent, a ketone-based solvent, an ether-based solvent, an ester-based solvent, and an aromatic hydrocarbon-based solvent. Among these solvent, an ether-based solvent or an aromatic hydrocarbon-based solvent is preferred.

(2) Monolayer Type Photosensitive Layer

The monolayer type photosensitive layer can be formed by preparing a coating liquid for the photosensitive layer, which contains a charge generating material, a charge transport material, a resin, and a solvent, forming the coating film, and drying the coating film. As the charge generating material, the charge transport material, and the resin, the same materials as those described above in the "(1) Laminated type photosensitive layer" can be used. The average layer thickness of the monolayer type photosensitive layer is preferably 10 μm or more and 45 μm or less.

(Protection Layer)

A protection layer may be arranged on a photosensitive layer within the range where the effect of the present invention is exerted. In a case where a protection layer is arranged, the protection layer serves as a surface layer. The protection layer contains a charge transport material, and a binder resin. Further, the protection layer may contain an additive agent such as a lubricant. The average layer thickness of the protection layer is preferably 2 μm or more and 10 μm or less.

<Process Cartridge, and Electrophotographic Apparatus>

The process cartridge according to the present invention integrally supports an electrophotographic photosensitive member that has been described so far and a charging unit having the charging member that has been described so far, and being detachably attached to an electrophotographic apparatus main body.

In addition, the electrophotographic apparatus according to the present invention has the process cartridge.

Figure 7:
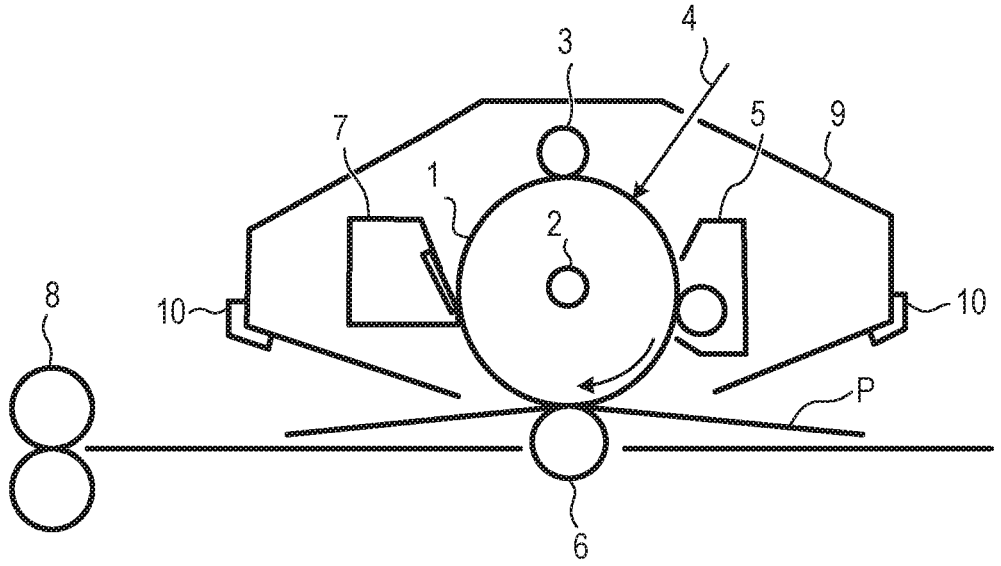
FIG. 7 is a diagram showing one example of the electrophotographic apparatus (electrophotographic image forming apparatus) according to the present invention.

In FIG. 7, one example of the schematic configuration of an electrophotographic apparatus having a process cartridge provided with an electrophotographic photosensitive member is shown.

In FIG. 7, the cylindrically-shaped electrophotographic photosensitive member 1 is rotationally driven at a predetermined peripheral speed in a direction of the arrow around the axis 2. The surface (circumferential surface) of the electrophotographic photosensitive member 1 to be rotationally driven is uniformly charged to a predetermined positive or negative potential by a charging unit 3 (primary charging unit: charging roller or the like). Next, exposure (image exposure) 4 is received from an exposing unit (not shown) such as slit exposure or laser beam scanning exposure. In this way, electrostatic latent images corresponding to the target images are sequentially formed on the surface of the electrophotographic photosensitive member 1.

The electrostatic latent image formed on a surface of the electrophotographic photosensitive member 1 is then developed with a toner contained in a developing agent of a developing unit 5 to form a toner image on the electrophotographic photosensitive member 1. Next, the toner image on the surface of the electrophotographic photosensitive member 1 is sequentially transferred to a transfer material (paper or the like) P by a transfer bias from a transferring unit (transfer roller or the like) 6. The toner image on the surface of the electrophotographic photosensitive member 1 may be transferred to a transfer material (paper or the like) via an intermediate transfer member. In this regard, the transfer material P is taken out from a transfer material feeding unit (not shown) and fed in between the electrophotographic photosensitive member 1 and the transferring unit 6 (abutting part) in synchronization with the rotation of the electrophotographic photosensitive member 1.

The transfer material P to which the toner image has been transferred is separated from the surface of the electrophotographic photosensitive member 1 and introduced into a fixing unit 8 to fix the toner image, and then discharged to the outside of the apparatus as an image formed matter (print, copy).

On the surface of the electrophotographic photosensitive member 1 after the transfer of a toner image, the residual developing agent (toner) after the transfer is removed from the surface of the electrophotographic photosensitive member 1 by a cleaning unit (cleaning blade or the like) 7. Next, the electrophotographic photosensitive member 1 is subjected to static elimination treatment by pre-exposure (not shown) from a pre-exposing unit (not shown), and then is repeatedly used for image formation. In this regard, as shown in FIG. 7, in a case where the charging unit 3 is a contact charging unit such as a charging roller, the pre-exposure is not necessarily required.

Among the above-described components of the electrophotographic photosensitive member 1, the charging unit 3, the developing unit 5, the transferring unit 6, the cleaning unit 7, and the like, multiple components may be selected, integrally combined, and housed in a container so as to be constituted as a process cartridge. In addition, this process cartridge may be detachably attached to an electrophotographic apparatus main body such as a copying machine, or a laser beam printer. In FIG. 7, the electrophotographic photosensitive member 1, the charging unit 3, the developing unit 5, and the cleaning unit 7 are integrally supported so as to be in a cartridge form. Further, a process cartridge 9 that is detachably attached to an electrophotographic apparatus main body is formed by using a guide unit 10 such as rails of the electrophotographic apparatus main body.

According to the present invention, a process cartridge and an electrophotographic apparatus, which are excellent in the stabilization of charging over a further longer period of use can be provided.

EXAMPLES

Hereinafter, the present invention will be described in more detail by way of Examples and Comparative Examples. The present invention is not limited at all by the following Examples as long as it does not exceed the gist of the present invention. Note that in the description of the following Examples, the term "parts" is on a mass basis unless otherwise specified. In each Example, a charging roller was prepared as the charging member.

<Production Example of electrophotographic photosensitive member>

(Method for Synthesizing Polycarbonate Resin)

As an example, a method for synthesizing a polycarbonate resin (1) by a phosgene method will be described below. Other polycarbonate resins were prepared in a similar manner as in the polycarbonate resin (1) except that the presence or absence of the use of bis(4-hydroxyphenyl) ether having a structure of the formula (I) and the kind and amount of the diol to be used were changed. In addition, the viscosity average molecular weight of the resin can be adjusted by appropriately changing the addition amount of a molecular weight regulator. Further, the polycarbonate resin according to the present invention may be synthesized by a transesterification method.

[Method for Synthesizing Polycarbonate Resin (1)]

24.3 g (0.12 mol) of bis(4-hydroxyphenyl) ether having a structure of the formula (I) was prepared. Further, 10.7 g (0.04 mol) of 2,2-bis(4-hydroxyphenyl)-4-methylpentane having a structure of the formula (II-1), and 1,1-bis(4-hydroxyphenyl)cyclohexane having a structure of the formula (II-2) were prepared. 64.4 g (0.24 mol) of those prepared above, and 0.1 g of hydrosulfite were dissolved. Into the obtained mixture, 500 ml of methylene chloride was added, and 60 g of phosgene was blown into the resultant mixture over 60 minutes while stirring the mixture and keeping the mixture at 15° C.

After the blowing of phosgene was completed, 1.3 g of p-t-butylphenol (product code: B0383 manufactured by TOKYO CHEMICAL INDUSTRY CO., LTD.) was added to the mixture as a molecular weight regulator, and the resultant mixture was stirred to emulsify the reaction mixture. After the emulsification, 0.4 ml of triethylamine was added, and the resultant mixture was stirred at 23° C. for 1 hour to perform the polymerization.

After completion of the polymerization, the reaction mixture was separated into an aqueous phase and an organic phase, the organic phase was neutralized with phosphoric acid, and washing with water was repeated until the conductivity of the wash liquid (aqueous phase) reached 10 μS/cm or less. The obtained polymer solution was added dropwise into warm water kept at 45° C., and a solvent was removed by evaporation to obtain white powdery precipitate. The obtained precipitate was filtered, and dried at 110° C. for 24 hours to obtain a polycarbonate resin (1) formed by copolymerization of a structure (I), a structure (II-1), and a structure (II-2).

The obtained polycarbonate resins (1) to (14) each were analyzed by infrared spectroscopy. As a result, the absorption by the carbonyl group was observed at a position in the vicinity of 1770 $cm^{-1}$ and the absorption by the ether bond was observed at a position in the vicinity of 1240 $cm^{-1}$, and thus the polycarbonate resin has been confirmed.

The ratio of structure in the produced polycarbonate resin and the viscosity average molecular weight (Mv) of the produced polycarbonate resin are shown in Table 1.

TABLE 1

| Polycarbonate resin | Ratio of structure in polycarbonate resin (mol %) | Viscosity average molecular weight (Mv) of polycarbonate resin |
|---|---|---|
| Polycarbonate resin (1) | (I)/(II-1)/(II-2) = 30/10/60 | 53000 |
| Polycarbonate resin (2) | (I)/(II-1)/(II-2) = 50/20/30 | 50000 |
| Polycarbonate resin (3) | (I)/(II-1)/(II-2) = 25/5/70 | 48000 |
| Polycarbonate resin (4) | (I)/(II-1)/(II-2) = 30/50/20 | 56000 |
| Polycarbonate resin (5) | (I)/(II-1) = 50/50 | 55000 |
| Polycarbonate resin (6) | (I)/(II-2) = 20/80 | 45000 |
| Polycarbonate resin (7) | (I)/(II-3) = 60/40 | 42000 |
| Polycarbonate resin (8) | (I)/(II-1)/(II-2) = 10/40/50 | 40000 |
| Polycarbonate resin (9) | (I)/(II-4) = 30/70 | 46000 |
| Polycarbonate resin (10) | (I)/(II-5) = 20/80 | 43000 |
| Polycarbonate resin (11) | (II-3) = 100 | 60000 |
| Polycarbonate resin (12) | (II-4) = 100 | 40000 |
| Polycarbonate resin (13) | (II-4)/(II-5) = 50/50 | 42000 |
| Polycarbonate resin (14) | (II-6) = 100 | 50000 |

[Method for Producing Electrophotographic Photosensitive Member (1)]

At first, 60 parts of barium sulfate particles covered with tin oxide (trade name: Passtran PC1, manufactured by MITSUI MINING & SMELTING CO., LTD.), and 15 parts of titanium oxide particles (trade name: TITANIX JR, manufactured by TAYCA CORPORATION) were prepared. Further, 43 parts of a resol-type phenol resin (trade name: PHENOLITE J-325, manufactured by DIC Corporation, solid content: 70% by mass), and 3.6 parts of a silicone resin (trade name: Tospearl 120, manufactured by Momentive Performance Materials Inc.) were prepared. Furthermore, 0.015 part of a silicone oil (trade name: SH28PA, manufactured by Dow Corning Toray Co., Ltd.) was prepared, and these prepared above were mixed with a solution including 50 parts of 1-methoxy-2-propanol and 50 parts of methanol. This mixture solution was subjected to dispersion treatment for 20 hours by a ball mill to prepare a coating liquid for a conductive layer.

This coating liquid for a conductive layer was applied by dip coating onto an aluminum cylinder (JIS-A3003, aluminum alloy) having a length of 254.7 mm and a diameter of 20 mm as a support, and the obtained coating film was dried at 140° C. for 30 minutes to form a conductive layer having a layer thickness of 30 μm.

Next, 10 parts of a copolymer nylon resin (trade name: AMILAN CM8000, manufactured by Toray Industries, Inc.) and 30 parts of a methoxymethylated 6 nylon resin (trade name: Toresin EF-30T, manufactured by Nagase ChemteX Corporation) were dissolved in a mixed solvent of 400 parts of methanol and 200 parts of n-butanol. In this way, a coating liquid for an undercoat layer was prepared. This coating liquid for an undercoat layer was applied by dip coating onto a conductive layer, and the obtained coating film was dried to form an undercoat layer having a layer thickness of 0.65 μm.

Next, 2 parts of polyvinyl butyral (trade name: S-LEC BX-1, manufactured by SEKISUI CHEMICAL CO., LTD.) was dissolved in 100 parts of cyclohexanone.

Into this solution, 4 parts of hydroxygallium phthalocyanine crystal (charge generating material) in a crystal form having a strong peak at Bragg angles 20±0.2° of 7.4° and 28.1° in CuKα characteristic X-ray diffraction was added. The resultant mixture was placed in a sand mill using glass beads having a diameter of 1 mm, and subjected to dispersion treatment for 1 hour under an atmosphere of 23±3° C. After the dispersion treatment, by the addition of 100 parts of ethyl acetate, a coating liquid for a charge generating layer was prepared. This coating liquid for a charge generating layer was applied by dip coating onto the above-described undercoat layer, and the obtained coating film was dried at 90° C. for 10 minutes to form a charge generating layer having a layer thickness of 0.20 μm.

Next, 5.4 parts of a compound represented by the formula (CTM-1), 0.6 part of a compound represented by the formula (CTM-2), and 10 parts of polycarbonate resin (1) were prepared. These prepared above were dissolved in a mixture solution of 33 parts of dimethoxymethane, 15 parts of ortho-xylene, and 25 parts of methyl benzoate, and a coating liquid for a charge transport layer was prepared.

This coating liquid for a charge transport layer was applied by dip coating onto the above-described charge generating layer to form a coating film, and the obtained coating film was dried at 130° C. for 30 minutes to form a charge transport layer (surface layer) having a layer thickness of 15 μm.

As described above, an electrophotographic photosensitive member (1) was prepared.

(Martens Hardness of Surface Layer of Electrophotographic Photosensitive Member)

The Martens hardness of a surface layer of an electrophotographic photosensitive member can be measured by using a microhardness measurement device (trade name: PICODENTOR HM500, manufactured by Fischer Instruments K.K.). The Martens hardness is measured under the condition of the push-in speed of the equation (1) by pressing an indenter of diamond in the shape of a quadrangular pyramid onto the measurement site under the environment of a temperature of 25° C. and a relative humidity of 50%.

$$dF/dt = 14 \text{ mN}/10 \text{ s} \quad (1)$$

where the "F" represents force, and the "t" represents time. In the evaluation of the surface layer of the electrophotographic photosensitive member, the hardness when the indenter is pushed with a force of 7 mN is extracted from the measurement result, and the Martens hardness is obtained.

The Martens hardness of the surface layer of the electrophotographic photosensitive member was measured by the technique described above. The Martens hardness of the surface layer of the electrophotographic photosensitive member (1) was 215 N/mm$^2$.

[Method for Producing Electrophotographic Photosensitive Members (2) to (15)]

Electrophotographic photosensitive members (2) to (15) were prepared in a similar manner as in the electrophotographic photosensitive member (1) except that the kind of the polycarbonate resin to be used for the preparation of a coating liquid for a charge transport layer and the ratio of the charge transport material and the resin were changed as shown in Table 2.

TABLE 2

| Electrophotographic photosensitive member | Kind of resin | Mass ratio of charge transport material/resin | Martens hardness N/mm$^2$ |
|---|---|---|---|
| Electrophotographic photosensitive member (1) | Polycarbonate resin (1) | 6/10 | 216 |
| Electrophotographic photosensitive member (2) | Polycarbonate resin (2) | 4/10 | 214 |
| Electrophotographic photosensitive member (3) | Polycarbonate resin (3) | 7/10 | 218 |
| Electrophotographic photosensitive member (4) | Polycarbonate resin (4) | 3/10 | 212 |
| Electrophotographic photosensitive member (5) | Polycarbonate resin (5) | 5/10 | 210 |
| Electrophotographic photosensitive member (6) | Polycarbonate resin (6) | 7/10 | 225 |
| Electrophotographic photosensitive member (7) | Polycarbonate resin (7) | 4/10 | 220 |
| Electrophotographic photosensitive member (8) | Polycarbonate resin (2) | 8/10 | 225 |
| Electrophotographic photosensitive member (9) | Polycarbonate resin (8) | 4/10 | 220 |
| Electrophotographic photosensitive member (10) | Polycarbonate resin (9) | 7/10 | 225 |
| Electrophotographic photosensitive member (11) | Polycarbonate resin (10) | 8/10 | 226 |
| Electrophotographic photosensitive member (12) | Polycarbonate resin (11) | 7/10 | 218 |
| Electrophotographic photosensitive member (13) | Polycarbonate resin (12) | 8/10 | 252 |
| Electrophotographic photosensitive member (14) | Polycarbonate resin (13) | 9/10 | 241 |
| Electrophotographic photosensitive member (15) | Polycarbonate resin (14) | 6/10 | 250 |

<Production Example of Charging Member>

(Production Example of Thermally Expandable Microcapsule Particles)

The following Production Examples 1 to 2 are a method for producing thermally expandable microcapsule particles 1 to 2 that are a material for forming hollow particles and bowl-shaped resin particles. In addition, unless otherwise particularly specified, as the reagents and the like that had not been specified, commercially available products with high purity were used.

Production Example 1 of Thermally Expandable Microcapsule Particles

An aqueous mixture of 4000 parts by mass of ion exchanged water, and as the dispersion stabilizer, 9 parts by mass of colloidal silica and 0.15 part by mass of polyvinyl pyrrolidone was prepared. Next, as the polymerizable monomer, 50 parts by mass of acrylonitrile, 45 parts by mass of methacrylonitrile, and 5 parts by mass of methyl methacrylate were prepared. Further, as the encapsulated substance, 4.2 parts by mass of isopentene and 7.5 parts by mass of normal hexane were prepared, and as the polymerization initiator, 0.75 part by mass of dicumyl peroxide was prepared. These prepared above were mixed to prepare an oily mixture. This oily mixture was added into the aqueous mixture described above, and into the resultant mixture, 0.4 part by mass of sodium hydroxide was further added to prepare a dispersion liquid.

The obtained dispersion liquid was stirred and mixed for 3 minutes by using a homogenizer, the mixture was charged into a polymerization reaction vessel purged with nitrogen gas, and the reaction was conducted at 60° C. for 20 hours under stirring at 400 rpm to prepare a reaction product. The obtained reaction product was repeatedly filtered and washed, and then dried at 80° C. for 5 hours to prepare thermally expandable microcapsule particles.

The obtained thermally expandable microcapsule particles were sieved by a dry air flow classifier (CLASSIEL N-20: manufactured by SEISHIN ENTERPRISE Co., Ltd.), and thermally expansible microcapsule particles 1 were obtained. As the classification condition, the rotation speed of a classifying rotor was set to be 1600 rpm.

The average particle diameter of thermally expandable microcapsule particles is indicated by the "volume average particle diameter" demanded by the following method. The measurement of the average particle diameter was performed by using a laser diffraction-type particle size analyzer (trade name: Coulter LS-230 type particle size analyzer, manufactured by Beckman Coulter, Inc.). In the measurement, an aqueous module was used, and pure water was used as a measurement solvent. The inside of the measurement system of the particle size analyzer was washed with pure water for around 5 minutes, and 10 mg to 25 mg of sodium sulfite was added into the measurement system as an antifoaming agent, and the background function was performed. Next, 3 to 4 drops of a surfactant were added into 50 ml of pure water, and further 1 to 25 mg of the measurement sample was added. An aqueous solution in which the sample had been suspended was subjected to dispersion treatment for 1 to 3 minutes by an ultrasonic disperser to prepare a test sample solution. The test sample solution was gradually added into the measurement system of the above-described measurement device, and the test sample concentration in the measurement system was adjusted so that the PIDS on the screen of the device is 45% or more and 55% or less, and the measurement was performed. The volume average particle diameter was calculated from the obtained volume distribution.

The volume average particle diameter of the obtained thermally expandable microcapsule particles 1 was 7.0 μm.

Production Example 2 of Thermally Expandable Microcapsule Particles

The thermally expandable microcapsule particles 2 were obtained in a similar manner as in Production Example 1 except that the amount of the colloidal silica was changed to 14 parts by mass, the rotation speed of the homogenizer during polymerization was changed to 1200 rpm, and the rotation speed of the classifying rotor was changed to 1800 rpm. The volume average particle diameter of the obtained thermally expandable microcapsule particles was 3.5 μm.

[Method for Producing Charging Member (1)]

(Preparation of unvulcanized rubber composition for elastic layer) By using a 6-liter pressure kneader (product name: TD6-15MDX, manufactured by Toshin. Co., Ltd.), the materials shown in the following Table 3 were mixed for 16 minutes at a filling rate of 70 vol % and a blade rotation speed of 30 rpm to obtain an A-kneading rubber composition.

TABLE 3

| | |
|---|---|
| Acrylonitrile butadiene rubber (trade name: N230SV manufactured by JSR Corporation) | 100 parts by mass |
| Zinc stearate | 1 part by mass |
| Zinc oxide | 5 parts by mass |
| Calcium carbonate (trade name: Super #1700 manufactured by MARUO CALCIUM CO., LTD.) | 15 parts by mass |

TABLE 3-continued

| | |
|---|---|
| Carbon black (trade name: TOKABLAC #7360SB manufactured by TOKAI CARBON CO., LTD.) | 50 parts by mass |

Next, the materials shown in the following Table 4 were mixed and bilaterally turned back 20 times in total by using open rolls each having a roll diameter of 12 inches (0.30 m) at a rotation speed of the front roll of 10 rpm, a rotation speed of the back roll of 8 rpm, and a gap between the rolls of 2 mm. After that, the resultant preparation was subjected to tight milling 10 times by setting the gap between the rolls to be 0.5 mm, and an unvulcanized rubber composition for a surface layer was obtained.

TABLE 4

| | |
|---|---|
| A-kneading rubber composition | 171 parts by mass |
| Sulfur | 1.2 parts by mass |
| Tetrabenzyl thiuram disulfide (trade name: NOCCELER TBzTD, manufactured by OUCHI SHINKO CHEMICAL INDUSTRIAL CO., LTD.) | 1.2 parts by mass |
| N-t-butyl-2-benzothiazole sulfenimide (trade name: SANTOCURE-TBSI, manufactured by FLEXYS) | 1.2 parts by mass |
| Thermally expandable microcapsule particles 1 (Production Example 1) | 3 parts by mass |

(Formation of Vulcanized Rubber Layer)

By using a crosshead extruder having a cylinder diameter of 70 mm, and L/D=20, the electroconductive substrate was covered with an unvulcanized rubber composition for a surface layer, and a vulcanized rubber roller in a crown shape was obtained. At this time, by setting the extrusion molding temperature to be 100° C. and the screw rotation speed to be 9 rpm, the vulcanized rubber roller was formed while changing the feeding rate of the electroconductive substrate. The length of the electroconductive substrate was 252.5 mm, the diameter of the electroconductive substrate was 6 mm, the die inner diameter of the crosshead extruder was 8.0 mm, the outer diameter at the center in the axis direction of the vulcanized rubber roller was 8.2 5 mm, and the outer diameter at the end part was 8.05 mm.

After that, the vulcanized rubber layer was vulcanized by heating at a temperature of 150° C. for 30 minutes in an electric air heating furnace, both ends of the vulcanized rubber layer were cut, and by setting the length in the axial direction of the vulcanized rubber layer to be 232 mm, a vulcanized rubber roller was obtained.

(Polishing Step)

The outer peripheral surface of the vulcanized rubber roller was polished by using a plunge-cut type cylindrical polishing machine. A vitrified grinding stone was used as the abrasive grains, green silicon carbide (GC) was used as the abrasive grains, and the grain size was set to be 100 mesh. The roller rotation speed was set to be 350 rpm, and the rotation speed of the grinding wheel was set to be 2050 rpm. By setting the cutting speed to be 20 mm/min and the spark-out time (time at the cutting of 0 mm) to be 0 second, the polishing was performed, and a polished rubber roller having an elastic layer was prepared. The thickness of the elastic layer was adjusted to be 1.5 mm. In this regard, the crown amount of this roller (average value of the difference between the outer diameter in the central part and the outer diameter at each of the positions 90 mm away from the central part toward both end parts) was 120 μm.

(Irradiation Treatment with UV Rays)

The prepared polished rubber roller was irradiated with UV rays to perform curing treatment, and a charging roller 1 having bowl-shaped resin particles on the surface layer of this example was obtained. At that time, the polished rubber roller was irradiated with UV rays having a wavelength of 254 nm so that the integrated light amount was 9000 $mJ/cm^2$. For the irradiation with UV rays, a low-pressure mercury lamp [manufactured by HARISON TOSHIBA LIGHTING Corporation] was used.

(Shape Measurement of Bowl-Shaped Resin Particles)

As the measurement positions, 10 positions were used in total, that is, two positions (phase 0° and 180°) in the circumferential direction of the charging member at each of the five positions in the longitudinal direction of the charging member, the five positions are one position in the central part in the longitudinal direction of the charging member, two positions 45 mm away from the central part toward both end parts, and two positions 90 mm away from the central part toward both end parts. At each of these measurement points, the conductive resin layer was cut out by 20 nm each over 500 μm by using a focused ion beam machining observation device (trade name: FB-2000C, manufactured by Hitachi, Ltd.), and a cross-sectional image was photographed. Subsequently, the obtained cross-sectional images were combined with one another to calculate a stereoscopic image of the bowl-shaped resin particle. From the stereoscopic image, the maximum diameter 45 was calculated as shown in FIG. 4. A value obtained by averaging the values of 100 points (100 concave portions) was taken as the maximum diameter. In this regard, the definition of the maximum diameter is as described above.

In addition, from the above-described stereoscopic image, the "difference between the outer diameter and the inner diameter", that is, the "thickness of the shell" of the bowl-shaped resin particle was calculated at arbitrary five positions of the bowl-shaped resin particle. The measurement as described above was performed for 10 resin particles within the field of view, and the average value of the obtained 50 measurement values in total was calculated. The values of the "maximum diameter" and "thickness of the shell" shown in Table 6 are average values calculated by the method described above. In this regard, in measuring the thickness of the shell, with respect to each of the bowl-shaped resin particles, it was confirmed that the thickness in the thickest part of the shell was twice or less the thickness in the thinnest part, that is, the thickness of the shell was substantially uniform.

(Measurement of Height Difference Between the Apex of Convex Portion and the Bottom of Concave Portion on Surface of Charging Member)

The surface of a charging member was observed with a field of view of 0.5 mm by 0.5 mm by using a laser microscope (trade name: LSMS PASCAL, manufactured by Carl Zeiss). The two-dimensional image data were obtained by scanning in the X-Y plane within the field of view with a laser, and further, the focal point was moved in the Z direction, and the above-described scanning was repeated to obtain the three-dimensional image data. As a result, firstly, it was confirmed that a concave portion 42 derived from an opening 47 of a bowl-shaped resin particle and a convex portion derived from an edge 43 of the opening 47 of the bowl-shaped resin particle were present. In addition, the height difference 44 between the apex of the convex portion derived from the edge 43 of the opening 47 and the bottom of the concave portion 42 was calculated. Such an operation was performed for two bowl-shaped resin particles within the field of view. Subsequently, similar measurement was performed at 50 positions in the longitudinal direction of a charging member T1, the average value of the obtained 100 resin particles in total was calculated, and this value was taken as the "height difference".

(Ten-Point Average Roughness)

The ten-point average roughness Rzjis was measured by using a surface roughness measuring instrument (trade name: SURFCORDER SE-3500, manufactured by Kosaka Laboratory Ltd.) in accordance with JIS B0601-2001. Six positions in total of two positions in the circumferential direction at each of three positions in the axial direction of the target member, and the average value was taken as the ten-point average roughness Rzjis.

The measurement conditions were as follows.

(Measurement environment) room temperature: 23° C.±2° C., humidity: 53%±10%

(Left-standing environment) for 5 hours or more under the environment of 23° C.±2° C. and 53%±10%

(Contact needle) tip shape: cone having a spherical tip, taper angle of cone: 60° tip radius: 2 μm, material: made of diamond (Measurement force) 0.75 mN (Rate of change in measurement force) 0 N/m (Measurement speed) 0.5 mm/s (Cut off) λc: 0.8 mm, λs: 2.5 μm (Cut off type) 2CR (phase non-compensation)

(Reference length) 0.8 mm (Evaluation length) 8.0 mm (Others) run up: 1.25 mm, run down: 1.25 mm (Pitch) 1 μm (Filter) Gaussian (Measurement of Martens Hardness)

The Martens hardness was measured by using a microhardness measurement device (trade name: PICODENTOR HM500, manufactured by Fischer Instruments K.K.). The measurement was performed under the condition of the push-in speed of the following equation (1).

$$dF/dt = 0.1 \text{ mN}/10 \text{ s} \quad (1)$$

(where the "F" represents force, and the "t" represents time.)

The hardness when the indenter is pushed with 0.04 mN is extracted from the measurement result, and the values obtained by the ten-point measurement and extraction in a similar way were averaged, and the average value of the Martens hardness was obtained.

[Method for Producing Charging Member (2)]

The charging member 2 was produced in a similar manner as in the charging member (1) except that the thermally expandable microcapsule particles 1 of the charging member (1) was changed to thermally expandable microcapsule particles 2.

[Method for Producing Charging Member (3)]

The charging member 3 was produced in a similar manner as in the charging member (1) except that additional heating at 200 degrees for 30 minutes was performed after the (Polishing step) of the charging member (1).

The physical properties of charging member of the charging members (1) to (3) are shown in Table 5.

TABLE 5

| Charging member | 1 | 2 | 3 |
|---|---|---|---|
| Thermally expandable microcapsule particles | 1 | 2 | 1 |
| Height difference [μm] | 36 | 20 | 34 |
| Maximum diameter [μm] | 33 | 15 | 31 |

TABLE 5-continued

| Charging member | 1 | 2 | 3 |
|---|---|---|---|
| Shell thickness [μm] | 0.5 | 0.6 | 0.5 |
| Rzjis [μm] | 31 | 19 | 32 |
| Martens hardness [N/mm$^2$] | 2 | 2 | 10 |

[Method for Producing Charging Member (4)]

The charging member 4 was produced by forming in a similar manner as in the charging member (1) until the step of (Formation of vulcanized rubber layer) of the charging member (1), and then by changing as described below.

(Additional Heat Treatment)

The vulcanized rubber roller was further heated at a temperature of 180° C. for 30 minutes in an electric air heating furnace, and an additionally heated rubber roller in which a recess was formed at the apex of the convex portion of the hollow particle exposed on a surface was obtained.

(Irradiation Treatment with UV Rays)

The prepared additionally vulcanized rubber roller was irradiated with UV rays to perform curing treatment, and a charging roller 4 of this example was obtained. At that time, the additionally vulcanized rubber roller was irradiated with UV rays having a wavelength of 254 nm so that the integrated light amount was 9000 mJ/cm$^2$. For the irradiation with UV rays, a low-pressure mercury lamp [manufactured by HARISON TOSHIBA LIGHTING Corporation] was used.

(Observation of Particle)

By using a confocal microscope (trade name: OPTELICS HYBRID, manufactured by Lasertec Corporation), the particle on a surface of the charging member was observed. The observation conditions were set to be 50× objective lens, the pixel number of 1024 pixels, and the height resolution of 0.1 μm. The particle was present in an exposed state.

(Measurement of Average Height of Convex Portions and Average Depth of Recess Derived from Hollow Particles)

The average depth of recess was determined by measuring the image of the recess depth on a surface of the charging member by using a confocal microscope (trade name: OPTELICS HYBRID, manufactured by Lasertec Corporation). The image of the recess depth is the distance between the apex of each of the convex portions and the lowest point of the recess, and therefore, the height of the convex portion necessary for the calculation was measured firstly. The observation conditions were set to be 50× objective lens, the pixel number of 1024 pixels, and the height resolution of 0.1 μm, and the value obtained by correcting the acquired image to be a flat image with a quadratic surface was taken as the height value.

From this height image, a cross-sectional profile of the convex portion of the hollow particle was extracted, and the distance between the lowest point of the recess and the apex of the convex portion was obtained. The apex indicates the highest part on the circumference around the recess.

A value obtained by averaging the values at 100 points (100 recesses) was taken as the average depth of recess.

(Measurement of Maximum Diameter and Average Thickness of Hollow Particle)

In order to measure the maximum diameter and average thickness of the hollow particle, a stereoscopic image of a hollow particle is obtained by acquiring an image while slicing the charging member thinly with a focused ion beam by using a focused ion beam-scanning electron microscope (trade name: Zeiss NVision 40 FIB, manufactured by Carl Zeiss).

At first, a cross-sectional image is photographed while cutting out an arbitrary convex portion and around the convex portion 0.1 μm in thickness at a time with a focused ion beam. By reconstructing the image acquired on the basis of the cross-sectional images into a stereoscopic image, a stereoscopic image showing a shape of the hollow particle is obtained.

From the stereoscopic image, the maximum diameter 53 was calculated as shown in FIG. 5. A value obtained by averaging the values at 100 points (100 recesses) was taken as the maximum diameter. In this regard, the definition of the maximum diameter is as described above.

In addition, a value obtained by averaging the shell thickness values of hollow particles of at 100 points (100 hollow parts) was taken as the average thickness of the hollow particles. In this regard, in measuring the thickness of the shell, with respect to each of the hollow particles, it was confirmed that the thickness in the thickest part of the shell was twice or less the thickness in the thinnest part, that is, the thickness of the shell was substantially uniform.

[Method for Producing Charging Member (5)]

The charging member (5) was produced in a similar manner as in the charging member (4) except that the thermally expandable microcapsule particles 1 of the charging member (4) was changed to thermally expandable microcapsule particles 2.

[Method for Producing Charging Member (6)]

The charging member (6) was produced in a similar manner as in the charging member (4) except for performing the (Irradiation treatment with electron beam) instead of the (Irradiation treatment with UV rays) of the charging member (4).

(Irradiation Treatment with Electron Beam)

The surface of the obtained vulcanized rubber roller was irradiated with an electron beam, and a charging member (6) having a cured area on a surface of the elastic layer was obtained. For the irradiation with an electron beam, an electron beam irradiator (manufactured by IWASAKI ELECTRIC Co., Ltd.) with a maximum acceleration voltage of 150 kV and a maximum electron current of 40 mA was used, and nitrogen was filled at the time of irradiation. The conditions of irradiation with an electron beam were set to be acceleration voltage: 150 kV, electron current: 35 mA, processing speed: 10 m/min, and oxygen concentration: 100 ppm.

The physical properties of charging member of the charging members (4) to (6) are shown in Table 6.

TABLE 6

| Charging member | 4 | 5 | 6 |
|---|---|---|---|
| Thermally expandable microcapsule particles | 1 | 2 | 1 |
| Average depth of recess [μm] | 2.3 | 0.9 | 1.9 |
| Maximum diameter [μm] | 32 | 16 | 27 |
| Shell thickness [μm] | 0.5 | 0.6 | 0.5 |
| Rzjis [μm] | 18 | 13 | 21 |
| Martens hardness [N/mm$^2$] | 2 | 2 | 8 |

Example 1

By using the electrophotographic photosensitive member (1) and charging member (1) produced in accordance with the above-described Production Example of electrophotographic photosensitive member and Production Example of charging member, the following evaluations were performed.

(Evaluation of Charging Unevenness after Durability)

As the evaluation device, a laser printer manufactured by Hewlett-Packard Company (trade name: Color LaserJet Pro M252n) was used. The evaluation was performed under the environment of a temperature of 15° C. and a humidity of 10% RH. A4-size plain paper of 50,000 sheets with character images at a coverage rate of 1% were output, and a half-tone image of one-dot Keima (knight of Japanese chess) patterns was output every 10,000 sheets as a sample for image evaluation. In this regard, the toner used in the laser beam printer was replenished every time when the printing became low density, and the evaluation was continued.

With respect to the evaluation for the charging unevenness, a half-tone image of one-dot Keima patterns was evaluated in accordance with the following criteria:

1: no streak-like image at all;

2: almost no streak-like image;

3: being a level not causing a problem in practical use although a streak-like image is slightly observed;

4: a streak-like image is observed; and

5: a streak-like image is clearly observed.

Examples 2 to 19, and Comparative Examples 1 to 3

The evaluation was performed in a similar manner as in Example 1 except that the combination of the charging member and the electrophotographic photosensitive member was changed. The results are shown in Table 7.

TABLE 7

| Example No. | Electrophotographic photosensitive member No. | Charging member No. | Charging unevenness 10,000 sheets | 20,000 sheets | 30,000 sheets | 40,000 sheets | 50,000 sheets |
|---|---|---|---|---|---|---|---|
| Example 1 | Electrophotographic photosensitive member (1) | Charging member (1) | 1 | 1 | 1 | 1 | 1 |
| Example 2 | Electrophotographic photosensitive member (1) | Charging member (2) | 1 | 1 | 1 | 1 | 1 |
| Example 3 | Electrophotographic photosensitive member (1) | Charging member (3) | 1 | 1 | 1 | 1 | 1 |
| Example 4 | Electrophotographic photosensitive member (1) | Charging member (4) | 1 | 1 | 1 | 1 | 1 |
| Example 5 | Electrophotographic photosensitive member (1) | Charging member (5) | 1 | 1 | 1 | 1 | 1 |
| Example 6 | Electrophotographic photosensitive member (1) | Charging member (6) | 1 | 1 | 1 | 1 | 1 |
| Example 7 | Electrophotographic photosensitive member (2) | Charging member (1) | 1 | 1 | 1 | 1 | 1 |
| Example 8 | Electrophotographic photosensitive member (2) | Charging member (4) | 1 | 1 | 1 | 1 | 1 |
| Example 9 | Electrophotographic photosensitive member (2) | Charging member (6) | 1 | 1 | 1 | 1 | 1 |
| Example 10 | Electrophotographic photosensitive member (3) | Charging member (1) | 1 | 1 | 1 | 1 | 2 |
| Example 11 | Electrophotographic photosensitive member (4) | Charging member (1) | 1 | 1 | 1 | 1 | 2 |
| Example 12 | Electrophotographic photosensitive member (5) | Charging member (1) | 1 | 1 | 1 | 2 | 2 |
| Example 13 | Electrophotographic photosensitive member (5) | Charging member (2) | 1 | 1 | 2 | 2 | 2 |
| Example 14 | Electrophotographic photosensitive member (5) | Charging member (3) | 1 | 1 | 1 | 1 | 2 |
| Example 15 | Electrophotographic photosensitive member (5) | Charging member (4) | 1 | 1 | 1 | 2 | 2 |
| Example 16 | Electrophotographic photosensitive member (5) | Charging member (5) | 1 | 1 | 2 | 2 | 2 |
| Example 17 | Electrophotographic photosensitive member (5) | Charging member (6) | 1 | 1 | 1 | 1 | 2 |
| Example 18 | Electrophotographic photosensitive member (6) | Charging member (1) | 1 | 1 | 1 | 2 | 2 |

TABLE 7-continued

| Example No. | Electrophotographic photosensitive member No. | Charging member No. | Charging unevenness 10,000 sheets | 20,000 sheets | 30,000 sheets | 40,000 sheets | 50,000 sheets |
|---|---|---|---|---|---|---|---|
| Example 19 | Electrophotographic photosensitive member (6) | Charging member (4) | 1 | 1 | 1 | 2 | 2 |
| Example 20 | Electrophotographic photosensitive member (6) | Charging member (5) | 1 | 1 | 2 | 2 | 3 |
| Example 21 | Electrophotographic photosensitive member (6) | Charging member (6) | 1 | 1 | 1 | 1 | 2 |
| Example 22 | Electrophotographic photosensitive member (7) | Charging member (1) | 1 | 1 | 2 | 2 | 2 |
| Example 23 | Electrophotographic photosensitive member (7) | Charging member (4) | 1 | 1 | 2 | 2 | 2 |
| Example 24 | Electrophotographic photosensitive member (7) | Charging member (5) | 1 | 1 | 2 | 3 | 3 |
| Example 25 | Electrophotographic photosensitive member (7) | Charging member (6) | 1 | 1 | 1 | 2 | 2 |
| Example 26 | Electrophotographic photosensitive member (8) | Charging member (1) | 1 | 1 | 1 | 2 | 2 |
| Example 27 | Electrophotographic photosensitive member (9) | Charging member (1) | 1 | 1 | 2 | 2 | 2 |
| Example 28 | Electrophotographic photosensitive member (10) | Charging member (1) | 1 | 1 | 2 | 2 | 3 |
| Example 29 | Electrophotographic photosensitive member (11) | Charging member (1) | 1 | 1 | 2 | 3 | 3 |
| Example 30 | Electrophotographic photosensitive member (11) | Charging member (4) | 1 | 2 | 2 | 3 | 3 |
| Example 31 | Electrophotographic photosensitive member (12) | Charging member (1) | 1 | 1 | 2 | 3 | 3 |
| Example 32 | Electrophotographic photosensitive member (12) | Charging member (4) | 1 | 2 | 2 | 3 | 3 |
| Comparative Example 1 | Electrophotographic photosensitive member (13) | Charging member (1) | 1 | 2 | 3 | 4 | 5 |
| Comparative Example 2 | Electrophotographic photosensitive member (14) | Charging member (4) | 1 | 2 | 3 | 4 | 4 |
| Comparative Example 3 | Electrophotographic photosensitive member (15) | Charging member (5) | 1 | 2 | 3 | 5 | 5 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-226347 filed Nov. 24, 2017, which is hereby incorporated by reference herein in its entirety.

What is claimed is:

1. A process cartridge, comprising:

a charging member; and an electrophotographic photosensitive member configured to be charged by being in contact with the charging member, said electrophotographic photosensitive member comprising a support and a photosensitive layer in this order, the charging member having an electroconductive substrate and a conductive elastic layer as a surface layer, the elastic layer containing a binder and a bowl-shaped resin particle having an opening, the opening being exposed on a surface of the charging member, a surface of the elastic layer comprising a concave portion derived from the opening and a convex portion derived from an edge of the opening, wherein a surface layer of the electrophotographic photosensitive member contains a charge transport material and a polycarbonate resin having structures represented by formulae (I) and (II), where formula (I) is (I)

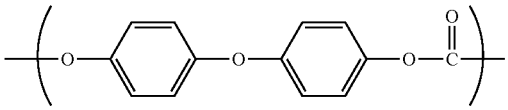

and formula (II) is at least one of formulae (II-1) to (II-5)

(II-1)

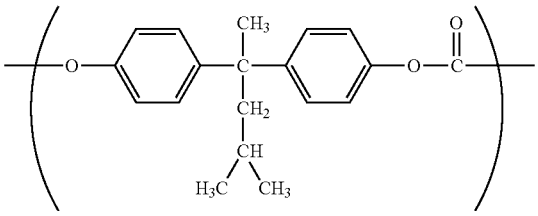

(II-2)

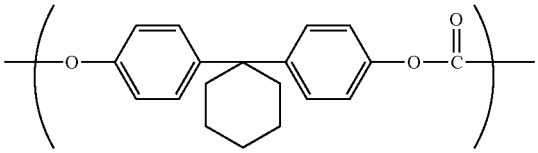

(II-3)

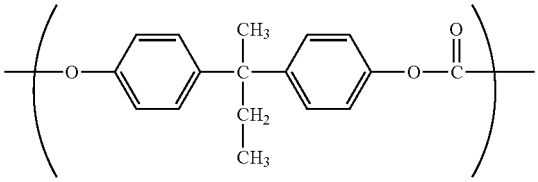

(II-4)

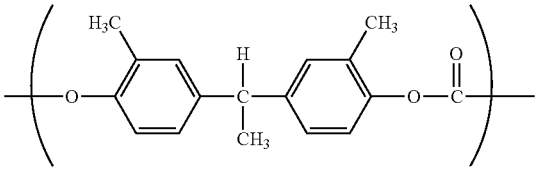

(II-5)

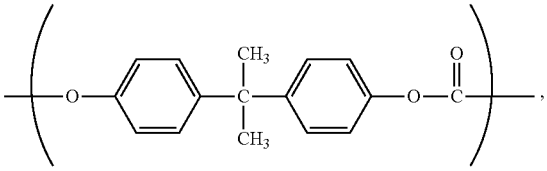

and the surface layer of the electrophotographic photosensitive member has a Martens hardness of 230 N/mm$^2$ or less.

2. A process cartridge, comprising:

a charging member; and an electrophotographic photosensitive member configured to be charged by being in contact with the charging member, the electrophotographic photosensitive member comprising a support and a photosensitive layer in this order, the charging member having an electroconductive substrate and a conductive elastic layer as a surface layer, a surface of the elastic layer containing an insulating hollow particle and an insulating binder, the hollow particle forming a convex portion exposed on the surface of the elastic layer, the hollow particle having a recess at the apex part of the convex portion, wherein a surface layer of the electrophotographic photosensitive member contains a charge transport material and a polycarbonate resin having structures represented by formulae (I) and (II), where formula (I) is (I)

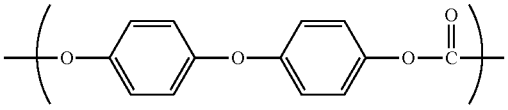

and formula (II) is at least one of formulae (II-1) to (II-5)

(II-1)

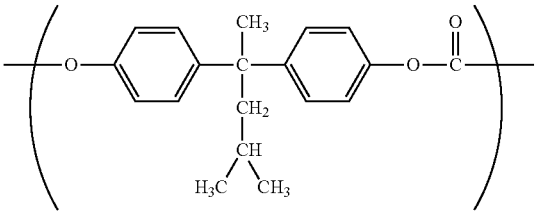

(II-2)

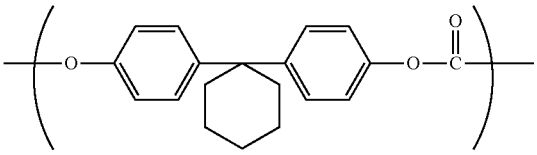

(II-3)

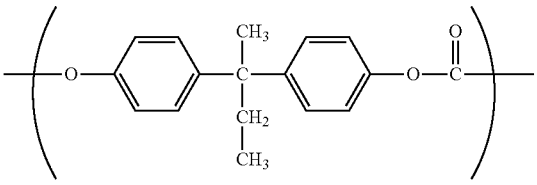

(II-4)

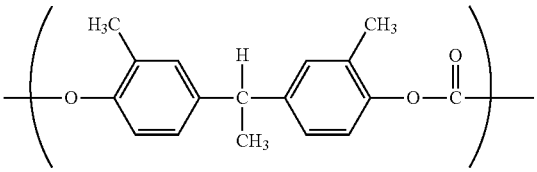

(II-5)

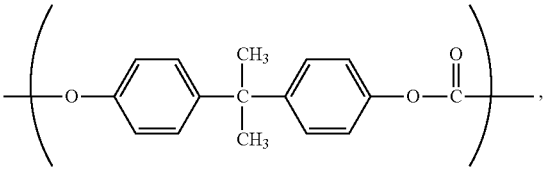

and the surface layer of the electrophotographic photosensitive member has a Martens hardness of 230 N/mm$^2$ or less.

3. The process cartridge according to claim 1, wherein the structure represented by formula (II) is at least one of formulae (II-1), (II-2) and (II-3).

4. The process cartridge according to claim 1, wherein the proportion of the structure represented by formula (I) in the polycarbonate resin is 20 to 60 mol %.

5. The process cartridge according to claim 1, wherein the charge transport material has a content of 30 to 70% by mass relative to a content of the polycarbonate resin in the surface layer.

6. The process cartridge according to claim 1, wherein the structure represented by formula (II) has a structure represented by formula (II-1) and a structure represented by formula (II-2).

7. The process cartridge according to claim 6, wherein the proportion of the structure represented by formula (II-1) is 0.1 to 1.0 times the proportion of the structure represented by formula (II-2) in terms of a molar ratio in the polycarbonate resin.

8. An electrophotographic apparatus, comprising:

at least one of a charging unit and an exposing unit; and a process cartridge, the process cartridge comprising a charging member and an electrophotographic photosensitive member configured to be charged by being in contact with the charging member, the electrophotographic photosensitive member comprising a support and a photosensitive layer in this order, the charging member having an electroconductive substrate, and a conductive elastic layer as a surface layer, the elastic layer containing a binder and a bowl-shaped resin particle having an opening, the opening being exposed on a surface of the charging member, a surface of the elastic layer comprising a concave portion derived from the opening and a convex portion derived from an edge of the opening, wherein a surface layer of the electrophotographic photosensitive member contains a charge transport material and a polycarbonate resin having structures represented by formulae (I) and (II), where formula (I) is (I)

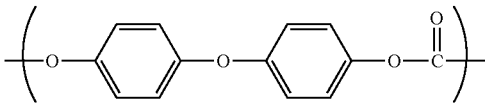

and formula (II) is at least one of formulae (II-1) to (II-5)

(II-1)

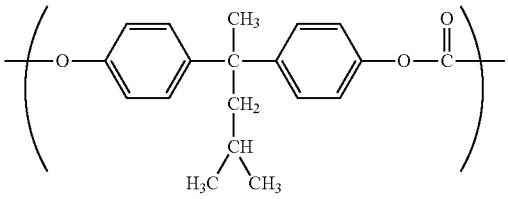

(II-2)

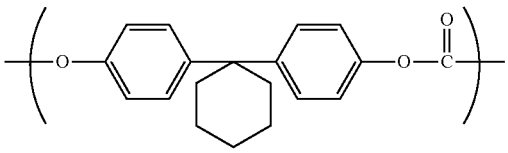

-continued (II-3)

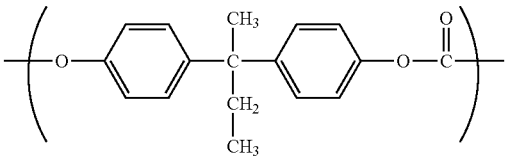

(II-4)

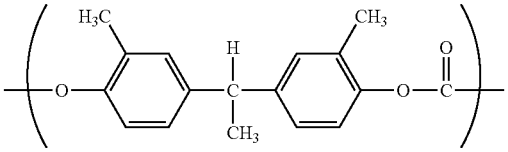

(II-5)

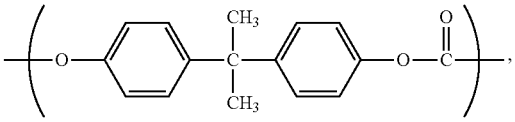

and the surface layer of the electrophotographic photosensitive member has a Martens hardness of 230 N/mm$^2$ or less.

9. The process cartridge according to claim 2, wherein the structure represented by formula (II) is at least one of formulae (II-1), (II-2) and (II-3).

10. The process cartridge according to claim 2, wherein the proportion of the structure represented by formula (I) in the polycarbonate resin is 20 to 60 mol %.

11. The process cartridge according to claim 2, wherein the charge transport material has a content of 30 to 70% by mass relative to a content of the polycarbonate resin in the surface layer.

12. The process cartridge according to claim 2, wherein the structure represented by formula (II) has a structure represented by formula (II-1) and a structure represented by formula (II-2).

13. The process cartridge according to claim 12, wherein the proportion of the structure represented by formula (II-1) is 0.1 to 1.0 times the proportion of the structure represented by formula (II-2) in terms of a molar ratio in the polycarbonate resin.

14. An electrophotographic apparatus, comprising:

at least one of a charging unit and an exposing unit; and a process cartridge, the process cartridge comprising a charging member and an electrophotographic photosensitive member configured to be charged by being in contact with the charging member, the electrophotographic photosensitive member comprising a support and a photosensitive layer in this order, the charging member having an electroconductive substrate, and a conductive elastic layer as a surface layer, a surface of the elastic layer containing an insulating hollow particle and an insulating binder, the hollow particle forming a convex portion exposed on the surface of the elastic layer, the hollow particle having a recess at the apex part of the convex portion, wherein a surface layer of the electrophotographic photosensitive member contains a charge transport material and a polycarbonate resin having structures represented by formulae (I) and (II), where formula (I) is (I)
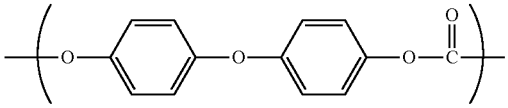
and formula (II) is at least one of formulae (II-1) to (II-5)
(II-1)
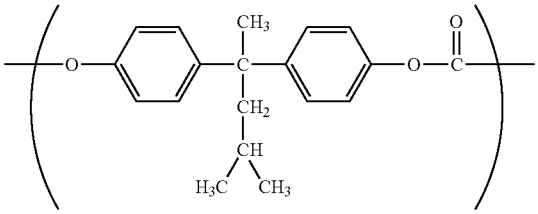
(II-2)
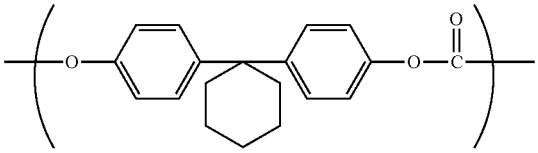
-continued
(II-3)
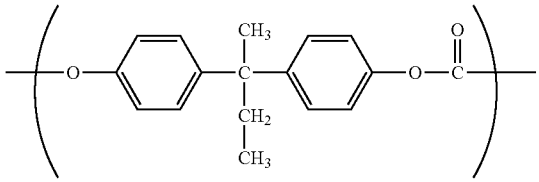
(II-4)
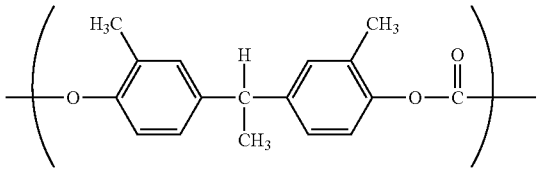
(II-5)
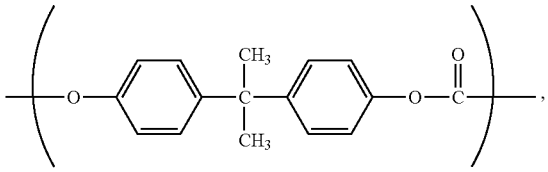
and
the surface layer of the electrophotographic photosensitive member has a Martens hardness of 230 $N/mm^2$ or less.
* * * * *